US010549567B2

(12) United States Patent
Asada et al.

(10) Patent No.: US 10,549,567 B2
(45) Date of Patent: Feb. 4, 2020

(54) DRYING DEVICE AND PRINTING APPARATUS

(71) Applicants: Kohki Asada, Tokyo (JP); Masato Ogawa, Kanagawa (JP)

(72) Inventors: Kohki Asada, Tokyo (JP); Masato Ogawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 36 days.

(21) Appl. No.: 15/818,680

(22) Filed: Nov. 20, 2017

(65) Prior Publication Data

US 2018/0147878 A1 May 31, 2018

(30) Foreign Application Priority Data

Nov. 26, 2016 (JP) ..... 2016-229615
Oct. 12, 2017 (JP) ..... 2017-198324

(51) Int. Cl.

| | |
|---|---|
| ***B41J 2/01*** | (2006.01) |
| ***B41M 7/00*** | (2006.01) |
| ***B41M 5/00*** | (2006.01) |
| ***B41J 11/00*** | (2006.01) |
| ***B41J 29/377*** | (2006.01) |

(52) U.S. Cl.

CPC ..... *B41M 7/009* (2013.01); *B41J 2/01* (2013.01); *B41J 11/002* (2013.01); *B41J 29/377* (2013.01); *B41M 5/0017* (2013.01); *B41J 11/0015* (2013.01)

(58) Field of Classification Search

CPC .... B41M 7/009; B41M 5/0017; B41J 29/377; B41J 11/002; B41J 2/01; B41J 11/0015

See application file for complete search history.

(56) References Cited

U.S. PATENT DOCUMENTS 3,033,390 A * 5/1962 Gronvold ..... E04H 6/14 198/797
4,729,194 A * 3/1988 Maier ..... B24B 23/04 451/357
2013/0108794 A1* 5/2013 Nakamoto ..... B41F 23/042 427/374.1
2013/0255130 A1* 10/2013 Baugh ..... A01K 97/10 43/4.5
2016/0167403 A1* 6/2016 Toya ..... F26B 13/183 347/102
2016/0273832 A1 9/2016 Asada et al.

(Continued)

FOREIGN PATENT DOCUMENTS

JP 60-050372 3/1985
JP 63-315880 12/1988

(Continued)

OTHER PUBLICATIONS

U.S. Appl. No. 15/598,839, filed May 18, 2017 Masato Ogawa, et al.

(Continued)

*Primary Examiner* — Henok D Legesse
(74) *Attorney, Agent, or Firm* — Duft & Bornsen, PC

(57) ABSTRACT

A drying device to dry a drying target member includes a plurality of holders and a circulator. The plurality of holders hold the drying target member. The circulator circulates the plurality of holders. The plurality of holders are supported by the circulator to rotate with respect to the circulator.

20 Claims, 23 Drawing Sheets

(56) References Cited

U.S. PATENT DOCUMENTS

| | | | |
|---|---|---|---|
| 2016/0370758 | A1 | 12/2016 | Ogawa et al. |
| 2017/0266987 | A1 | 9/2017 | Asada et al. |
| 2017/0266988 | A1 | 9/2017 | Asada et al. |
| 2017/0266989 | A1 | 9/2017 | Ogawa et al. |

FOREIGN PATENT DOCUMENTS

| | | | | |
|---|---|---|---|---|
| JP | 2-279981 | | 11/1990 | |
| JP | 3-288709 | | 12/1991 | |
| JP | 6-056017 | | 8/1994 | |
| JP | H06-056017 | * | 8/1994 | ..... B65G 1/127 |
| JP | 7-106734 | | 4/1995 | |
| JP | 9-197737 | | 7/1997 | |
| JP | 2003-094748 | | 4/2003 | |
| JP | 2009-073638 | | 4/2009 | |
| JP | 2013-169777 | | 9/2013 | |
| JP | 2015-098388 | | 5/2015 | |

OTHER PUBLICATIONS

U.S. Appl. No. 15/644,009, filed Jul. 7, 2017 Kohki Asada, et al.

* cited by examiner

DRYING DEVICE AND PRINTING APPARATUS

CROSS-REFERENCE TO RELATED APPLICATIONS

This patent application is based on and claims priority pursuant to 35 U.S.C. § 119(a) to Japanese Patent Application Nos. 2016-229615, filed on Nov. 26, 2016, and 2017-198324, filed on Oct. 12, 2017 in the Japan Patent Office, the entire disclosure of each of which is hereby incorporated by reference herein.

BACKGROUND

Technical Field

Aspects of the present disclosure relate to a drying device and a printing apparatus.

Related Art

A drying device is known that circulates a plurality of holders to hold members to be dried (drying target members) around an imaginary axis extending in a horizontal direction to dry at least drying target portions of the drying target members held by the holders.

SUMMARY

In an aspect of the present disclosure, there is provided a drying device to dry a drying target member. The drying device includes a plurality of holders and a circulator. The plurality of holders hold the drying target member. The circulator circulates the plurality of holders. The plurality of holders are supported by the circulator to rotate with respect to the circulator.

In another aspect of the present disclosure, there is provided a printing apparatus that includes a liquid discharger and the drying device. The liquid discharger discharges liquid onto a sheet. The drying device dries the liquid discharged by the liquid discharger and adhered to the sheet.

In still another aspect of the present disclosure, there is provided a printing apparatus that includes a liquid discharger, a pre-processing unit, and the drying device. The liquid discharger discharges liquid onto a sheet. The pre-processing unit is disposed upstream from the liquid discharger in a direction of conveyance of the sheet, to apply a treatment liquid to the sheet before the liquid is discharged to the sheet. The drying device dries the sheet on which the treatment liquid has been applied by the pre-processing unit.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
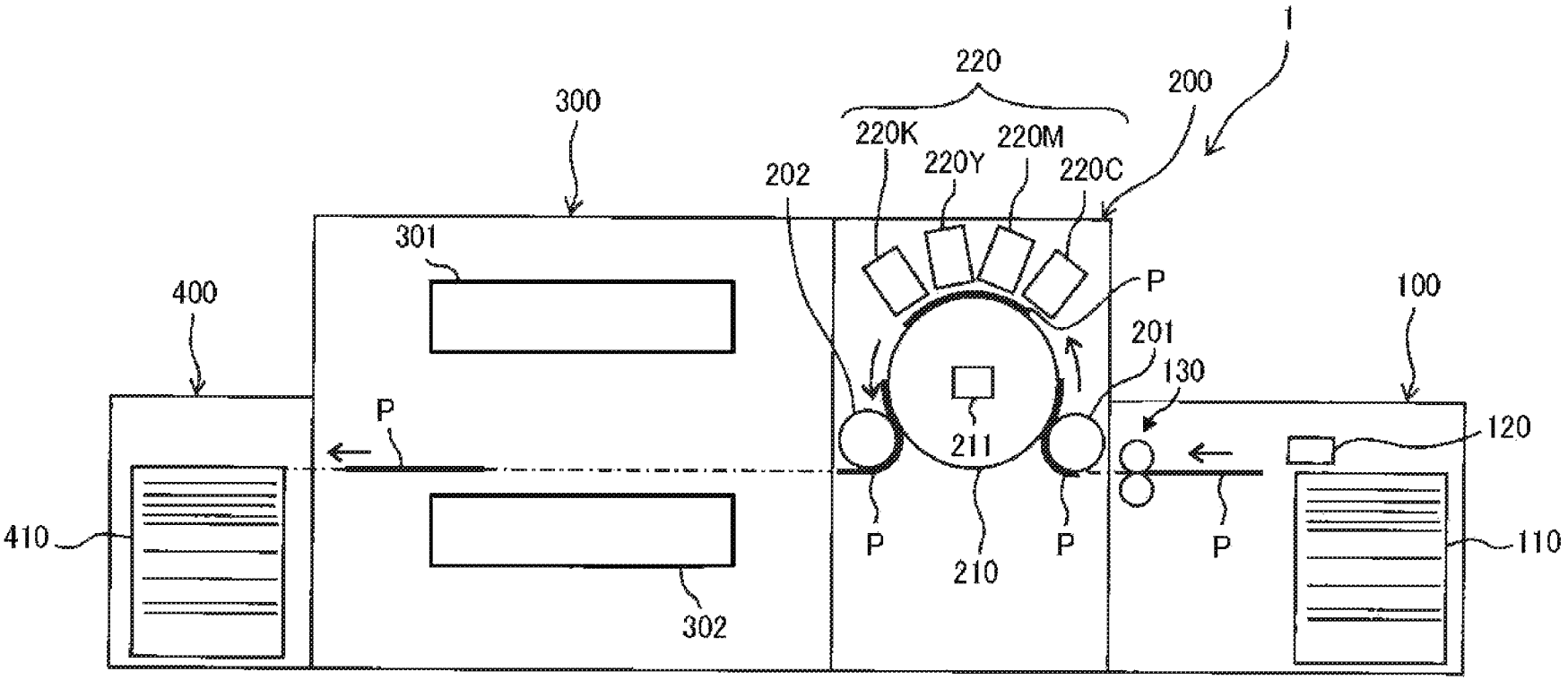
FIG. 1 is a schematic view of a configuration of an inkjet recording apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Hereinafter, embodiments of the present disclosure are described with reference to the drawings.

Overall Description

FIG. 1 is a schematic view of a configuration of an inkjet recording apparatus according to an embodiment of the present disclosure. An inkjet recording apparatus 1 according to the present embodiment includes, for example, a sheet feeding unit 100, an image forming unit 200, a drying unit 300, and a sheet ejection unit 400. In the inkjet recording apparatus 1, an image is formed on the sheet P, which is a recording material as a sheet material fed from the sheet feeding unit 100, with ink that is a liquid for image formation in the image forming unit 200. After the ink adhered to the sheet is dried in the drying unit 300, the sheet is ejected from the sheet ejection unit 400.

Sheet Feeding Unit

The sheet feeding unit 100 includes, for example, a sheet feed tray 110 on which a plurality of sheets P is stacked, a sheet feeder 120 to separate and feed the sheets P one by one from the sheet feed tray 110, and paired registration rollers 130 to send the sheet P to the image forming unit 200. As the sheet feeder 120, any sheet feeder, such as a device using rollers or a device using air suction, can be used. After the leading end of the sheet fed from the sheet feed tray 110 by the sheet feeder 120 reaches the paired registration rollers 130, the paired registration rollers 130 are driven at a predetermined timing to feed the sheet to the image forming unit 200. In the present embodiment, the sheet feeding unit 100 is not limited to the above-described configuration and may be any other configuration capable of sending the sheet P to the image forming unit 200.

Image Forming Unit

The image forming unit 200 includes, for example, a transfer cylinder 201 to receive the fed sheet P and transfer the fed sheet P to a sheet bearing drum 210, a sheet bearing drum 210 to bear and convey the sheet P conveyed by the transfer cylinder 201 on an outer circumferential surface of the sheet bearing drum 210, an ink discharge unit 220 to discharge ink toward the sheet P borne on the sheet bearing drum 210, and a transfer cylinder 202 to transfer the sheet P conveyed by the sheet bearing drum 210 to the drying unit 300.

The leading end of the sheet P conveyed from the sheet feeding unit 100 to the image forming unit 200 is gripped by a sheet gripper provided on the surface of the transfer cylinder 201 and conveyed with the movement of the surface of the transfer cylinder 201. The sheet conveyed by the transfer cylinder 201 is delivered to the sheet bearing drum 210 at a position facing the sheet bearing drum 210.

The sheet gripper is also disposed on the surface of the sheet bearing drum 210, and the leading end of the sheet is gripped by the sheet gripper. A plurality of suction holes are dispersedly formed on the surface of the sheet bearing drum 210, and a sucked air flow directed toward the inside of the sheet bearing drum 210 is generated in each suction hole by a suction device 211. The leading end of the sheet P delivered from the transfer cylinder 201 to the sheet bearing drum 210 is gripped by the sheet gripper, and the sheet is attracted to the surface of the sheet bearing drum 210 by the suction air flow and is conveyed with the movement of the surface of the sheet bearing drum 210.

The ink discharge unit 220 according to the present embodiment discharges inks of four colors of C (cyan), M (magenta), Y (yellow), and K (black) to form an image, and includes individual liquid discharge heads 220C, 220M, 220Y and 220K for respective inks. The configurations of the liquid discharge heads 220C, 220M, 220Y, and 220K are not limited to the above-described configurations and may be any other suitable configurations. The ink discharge unit 220 may include, for example, a liquid discharge head to discharge special ink, such as white, gold, and silver, or a liquid discharge head to discharge a liquid that does not constitute an image, such as a surface coating liquid, as needed.

The discharge operation of the liquid discharge heads 220C, 220M, 220Y, and 220K of the ink discharge unit 220 is controlled by drive signals corresponding to image information. When the sheet P borne on the sheet bearing drum 210 passes through a region opposed to the ink discharge unit 220, ink of respective colors is discharged from the liquid discharge heads 220C, 220M, 220Y, and 220K to form an image in accordance with the image information. In the present embodiment, the configuration of the image forming unit 200 is not limited to the above-described configuration and may be any other configuration of forming an image by causing liquid to adhere onto the sheet P.

Drying Unit

The drying unit 300 includes, for example, a drying assembly 301 to dry the ink adhered onto the sheet P by the image forming unit 200, and a conveyance assembly 302 to convey the sheet P conveyed from the image forming unit 200. After the sheet P conveyed from the image forming unit 200 is received by the conveyance assembly 302, the sheet is conveyed to pass through the drying assembly 301 and delivered to the sheet ejection unit 400. When the sheet P passes the drying assembly 301, the ink on the sheet P is subjected to a drying process. Thus, the liquid content, such as moisture, in the ink evaporates, the ink is fixed on the sheet P, and the curl of the sheet P is reduced.

Sheet Ejection Unit

The sheet ejection unit 400 includes, for example, a sheet ejection tray 410 on which a plurality of sheet P is stacked. The sheet P conveyed from the drying unit 300 is sequentially stacked and held on the sheet ejection tray 410. In the present embodiment, the configuration of the sheet ejection unit 400 is not limited to the above-described configuration and may be any other configuration capable of ejecting the sheet P.

Other Functional Units

The inkjet recording apparatus 1 according to the present embodiment includes the sheet feeding unit 100, the image forming unit 200, the drying unit 300, and the sheet ejection unit 400. In addition, other functional units may be added as needed. For example, a pre-processing unit to perform pre-processing of image formation can be added between the sheet feeding unit 100 and the image forming unit 200, or a post-processing unit to perform post-processing of image formation can be added between the drying unit 300 and the sheet ejection unit 400.

As the pre-processing unit, for example, there is a unit to perform a treatment liquid application process of applying a treatment liquid for reacting with ink to reduce bleeding to the sheet P. However, the content of the pre-processing is not particularly limited to any specific content. In addition, as the post-processing unit, for example, there is a sheet reverse conveyance processing with the image formed by the image forming unit 200 and sending the sheet to the image forming unit 200 again to form images on both sides of the sheet, or a process for binding a plurality of sheets on which the image is formed, and the like. However, the content of the post-processing is also not particularly limited to any specific content.

In the present embodiment, the printing apparatus is described using an example of an inkjet recording apparatus. However, the "printing apparatus" is not limited to an apparatus that includes a liquid discharge head to discharge liquid toward a surface to be dried of the sheet material, and to make visible significant images, such as letters and graphics, with the discharged liquid. For example, the "printing apparatus" may also be an apparatus to form patterns and the like which have no meaning. The material of the sheet material is not limited, and any sheet material, such as paper, thread, fiber, cloth, leather, metal, plastic, glass, wood, and ceramics, to which liquid can temporarily adhere may be used. For example, sheet materials used for film products, cloth products, such as clothing products, building materials, such as a wall sheet or flooring materials, leather products, and the like may be used. The "printing apparatus" can also include units relating to feeding, conveying, and ejection of a sheet to which liquid can adhere, a pre-processing device, a post-processing device and the like. Further, the term "liquid" includes any liquid having a viscosity or a surface tension that can be discharged from the head. The "liquid" is not limited to a particular liquid and may be any liquid having a viscosity or a surface tension to be discharged from a head. However, preferably, the viscosity of the liquid is not greater than 30 mPa·s under ordinary temperature and ordinary pressure or by heating or cooling. More specifically, the "liquid" is, for example, solution, suspension, emulsion or the like that includes a solvent, such as water or an organic solvent, a colorant, such as a dye or a pigment, a functionalizing material, such as a polymerizable compound, a resin, or a surfactant, a biocompatible material, such as DNA, amino acid, protein, or calcium, edible materials, such as natural colorants, and the like. Such liquids can be used, for example, for inkjet inks, surface treatment liquids and the like. Although there is an apparatus in which the liquid discharge head and the sheet material relatively move as the "printing apparatus", embodiments of the present disclosure are not limited to such an apparatus. The "printing apparatus" may be, for example, a serial-type apparatus to move a liquid discharge head relative to a sheet material or a line-type apparatus that does not move a liquid discharge head relative to a sheet material.

Further, the term "liquid discharge head" represents a functional component to discharge and jet liquid from discharge orifices (nozzles). As an energy generating source to discharge liquid, a discharge energy generator, for example, a piezoelectric actuator (lamination-type piezoelectric element and thin-film piezoelectric element), a thermal actuator using an electrothermal transducer element, such as a heating resistor (element), or an electrostatic actuator including a diaphragm plate and opposed electrodes can be used. However, the energy generating source is not limited to any specific type and may be any other suitable discharge energy generator.

Details of Drying Unit

Figure 2:
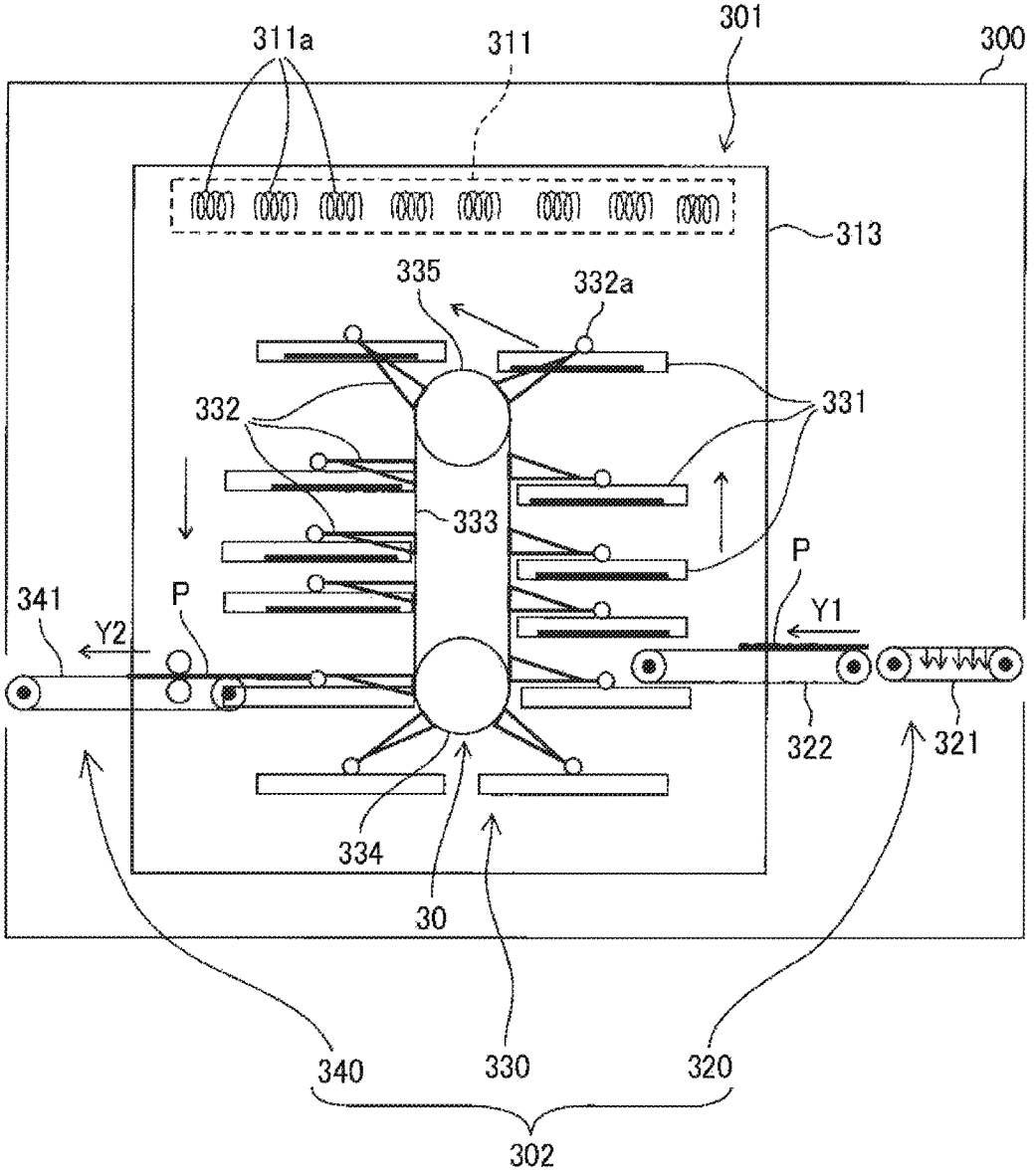
FIG. 2 is a schematic view of a drying unit of the inkjet recording apparatus illustrated in FIG. 1.

Next, the drying unit 300 in the present embodiment is further described below. FIG. 2 is a schematic view of the drying unit 300 in the present embodiment. The drying assembly 301 in the drying unit 300 of the present embodiment has, for example, a non-contact heat source unit 311 including a plurality of infrared heaters 311*a* as a plurality of non-contact heat sources and a drying chamber 313. At least a part of a wall member of the drying chamber 313 is formed of a heat insulating material so that the internal temperature of the drying chamber 313 is not easily lowered. In the drying assembly 301, the sheet P as a member to be dried (a drying target member) is conveyed into an internal space of the drying chamber 313. Ink as a portion to be dried (a drying target portion) on the image surface of the sheet P is dried by the radiant heat of infrared heaters 311*a*. Note that the "drying target member" is not limited to the sheet P of paper but may be any member to be dried. The "drying target portion" is not limited to ink but may be any portion to be dried in the drying target member.

The conveyance assembly 302 according to the present embodiment includes, for example, a carry-in unit 320, a drying conveyance unit 330, and a carry-out unit 340. The carry-in unit 320 receives the sheet P from the transfer cylinder 202 of the image forming unit 200 and conveys the sheet P into the drying chamber 313. The drying conveyance unit 330 conveys the sheet P in the drying chamber 313. The carry-out unit 340 conveys the sheet P from the drying chamber 313.

The carry-in unit 320 includes a belt receiving mechanism 321 to receive the sheet P from the transfer cylinder 202 of the image forming unit 200 and a belt carry-in mechanism 322 to carry the sheet P into the drying chamber 313. In the belt receiving mechanism 321, a plurality of suction holes are provided in a belt. The sheet P is attracted to the belt by suction force from the suction holes and conveyed by the belt. The belt carry-in mechanism 322 is described later.

The drying conveyance unit 330 is disposed in a substantially central portion in the drying chamber 313 and mainly includes a plurality of drying racks 331 as holders to hold sheets P and a circulator 30 to circulate the plurality of drying racks 331 around an imaginary axis (hereinafter referred to as "horizontal axis) extending in a horizontal direction. The circulator 30 includes a driven gear 334 disposed at a lower side of the drying chamber 313, a driving gear 335 disposed at an upper side of the drying chamber 313, and a conveyor chain 333 meshing with the driven gear 334 and the driving gear 335. The circulator 30 is disposed at each of the front side and the rear side of the inkjet recording apparatus 1. A plurality of arms 332 extending in the normal direction are mounted to each conveyor chain 333, and the drying racks 331 are rotatably supported in such a manner that each of the drying racks 331 is suspended at a leading end of each arm 332.

The belt carry-in mechanism 322 is disposed in an area in which the drying racks 331 move from below to above, and the carry-out unit 340 is disposed in an area in which the drying racks 331 move from above to below. The non-contact heat source unit 311 is disposed at an upper area of the drying chamber 313.

The sheet P conveyed into the drying chamber 313 by the belt carry-in mechanism 322 is held on the drying rack 331 and moves upward. Ink as the drying target portion on the image surface of the sheet P is dried by radiant heat of the infrared heaters 311*a* of the non-contact heat source unit 311, which is disposed at the upper area of the drying chamber 313. Then the sheet P is moved downward and carried out from the drying chamber 313 by the carry-out unit 340. The carry-out unit 340 includes a belt carry-out mechanism 341 having a configuration similar to a configuration of the belt carry-in mechanism 322 described later.

Figure 3:
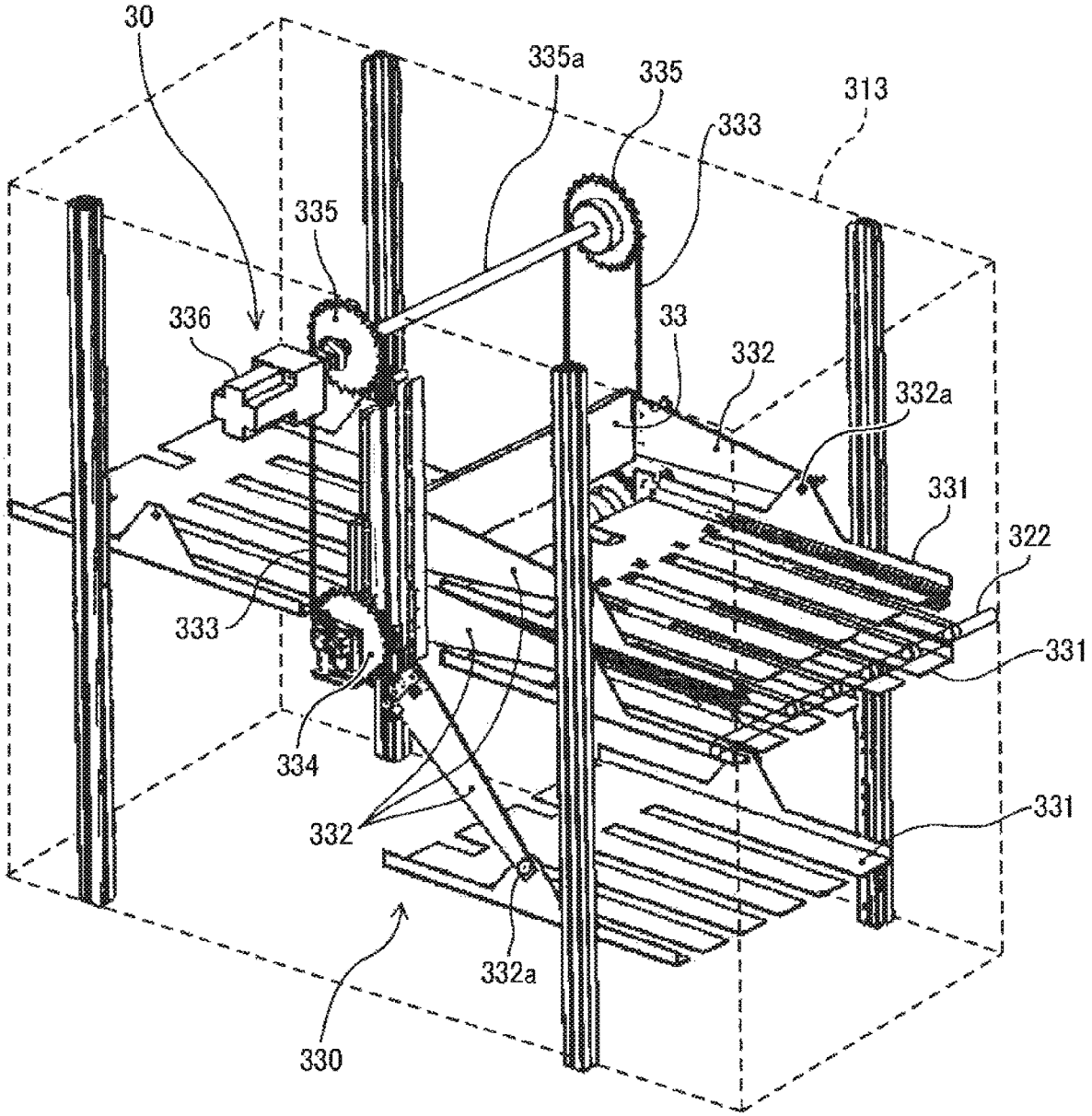
FIG. 3 is a perspective view of a drying conveyance unit.

FIG. 3 is a perspective view of the drying conveyance unit 330. The conveyor chain 333 is provided on each of the front side and the rear side in the drying chamber 313. The driving gear 335 on the front side and the driving gear 335 on the rear side are attached to a drive shaft 335*a* so as to be rotatable with the drive shaft 335*a* as a single unit. The drive shaft 335*a* is connected to a drive motor 336 via, e.g., a joint. The driven gear 334 on the front side and the driven gear 334 on the back side are attached to the driven shaft so as to be rotatable with the driven shaft as a single unit.

The conveyor chain 333, the driven gear 334, and the driving gear 335 constituting the circulator 30 are made of metal. Using metal can provide a greater heat resistance than using resin, thus reducing thermal expansion. Accordingly, the drying racks 331 can be stably circulated.

Figure 4:
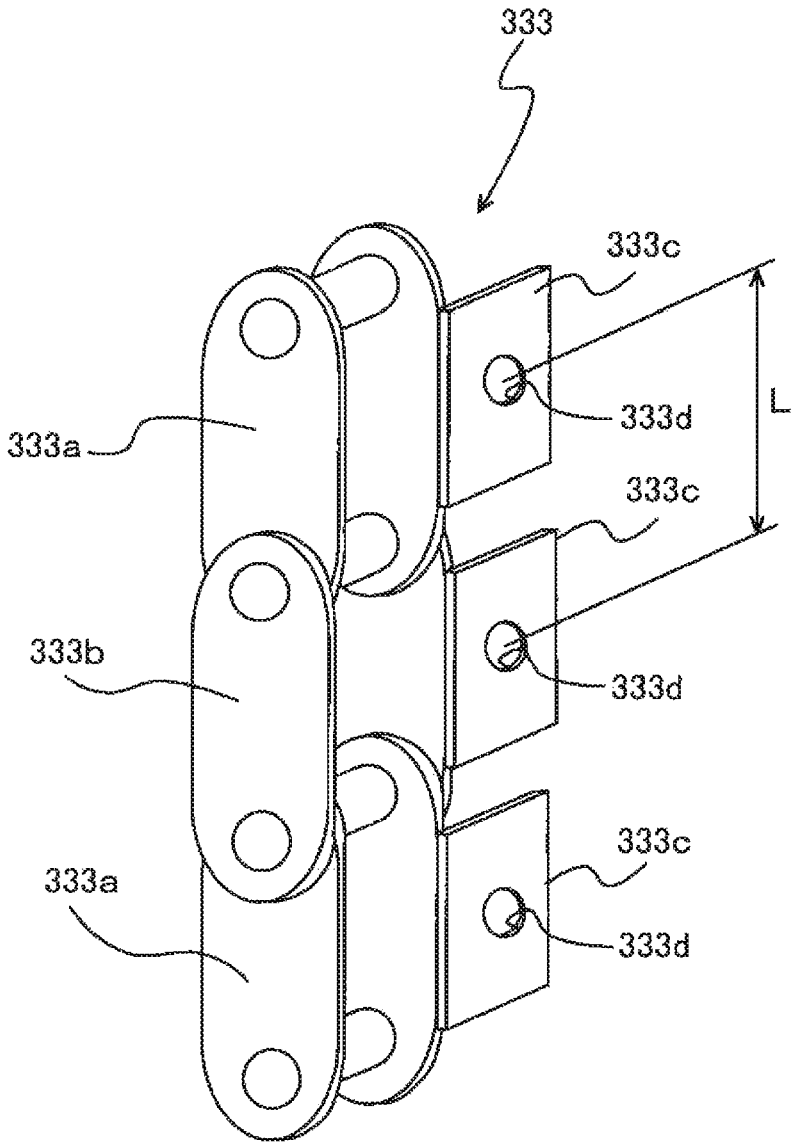
FIG. 4 is a schematic perspective view of a portion of a conveyor chain.

FIG. 4 is a schematic perspective view of a portion of the conveyor chain 333. In FIG. 4, the conveyor chain 333 on the front side of the inkjet recording apparatus 1 is illustrated. The conveyor chain 333 includes inner links 333*a* and outer links 333*b* that are alternately linked. Each of the inner links 333*a* and the outer links 333*b* has a member mount portion 333*c* having a plate shape. A bolt fastening hole 333*d* is disposed in the center of the member mount portion 333*c*. The interval L between the bolt fastening holes 333*d* is a chain pitch. Mounting a member to each member mount portion 333*c* allows the member to be mounted at a prescribed pitch without adjustment. The conveyor chain 333 on the rear side of the inkjet recording apparatus 1 has the member mount portion 333*c* on the opposite side of the side at which the member mount portion 333*c* is disposed in FIG. 4.

Figure 5:
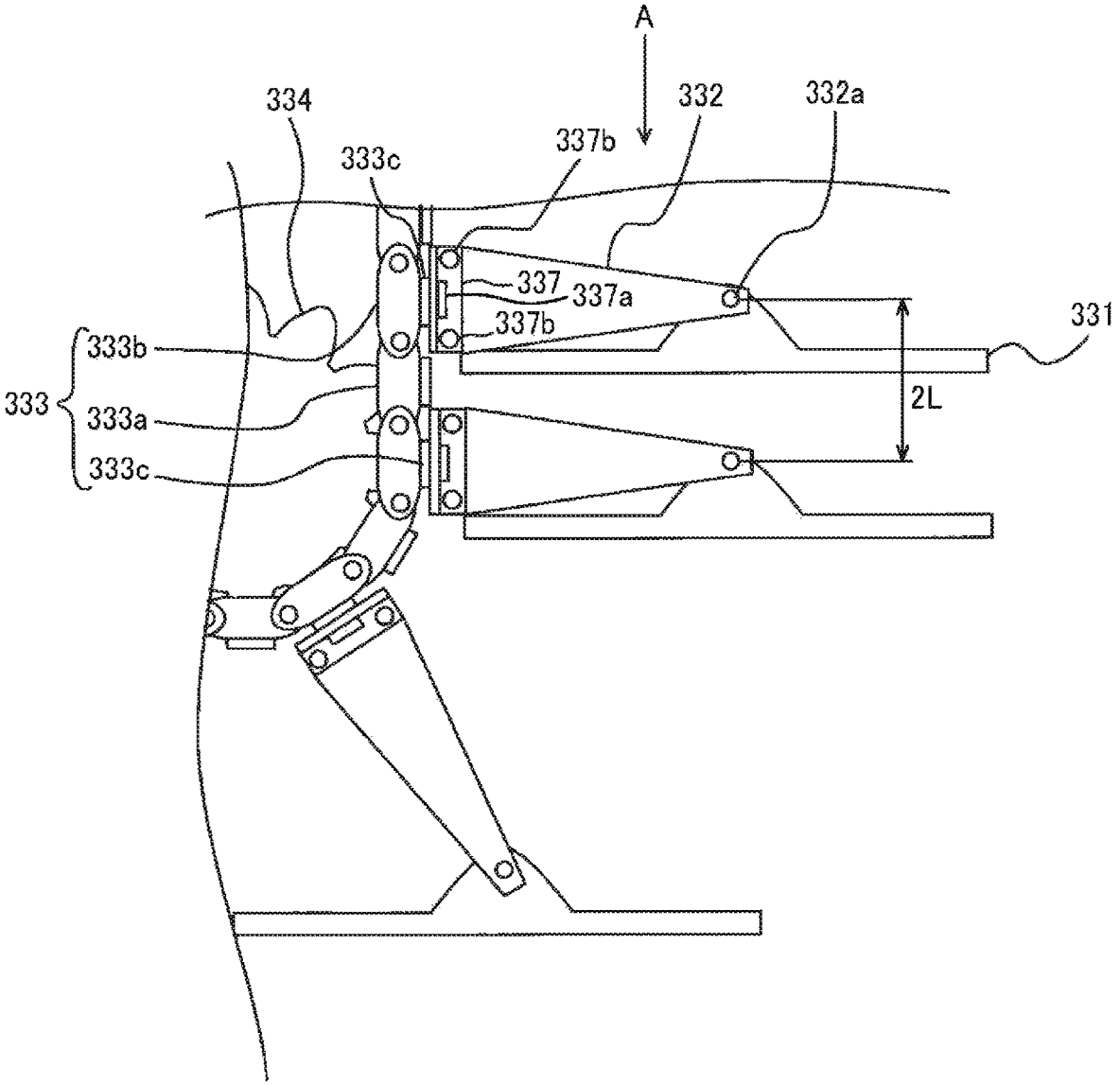
FIG. 5 is an enlarged view of a portion of the drying conveyance unit of FIG. 3.
Figure 6:
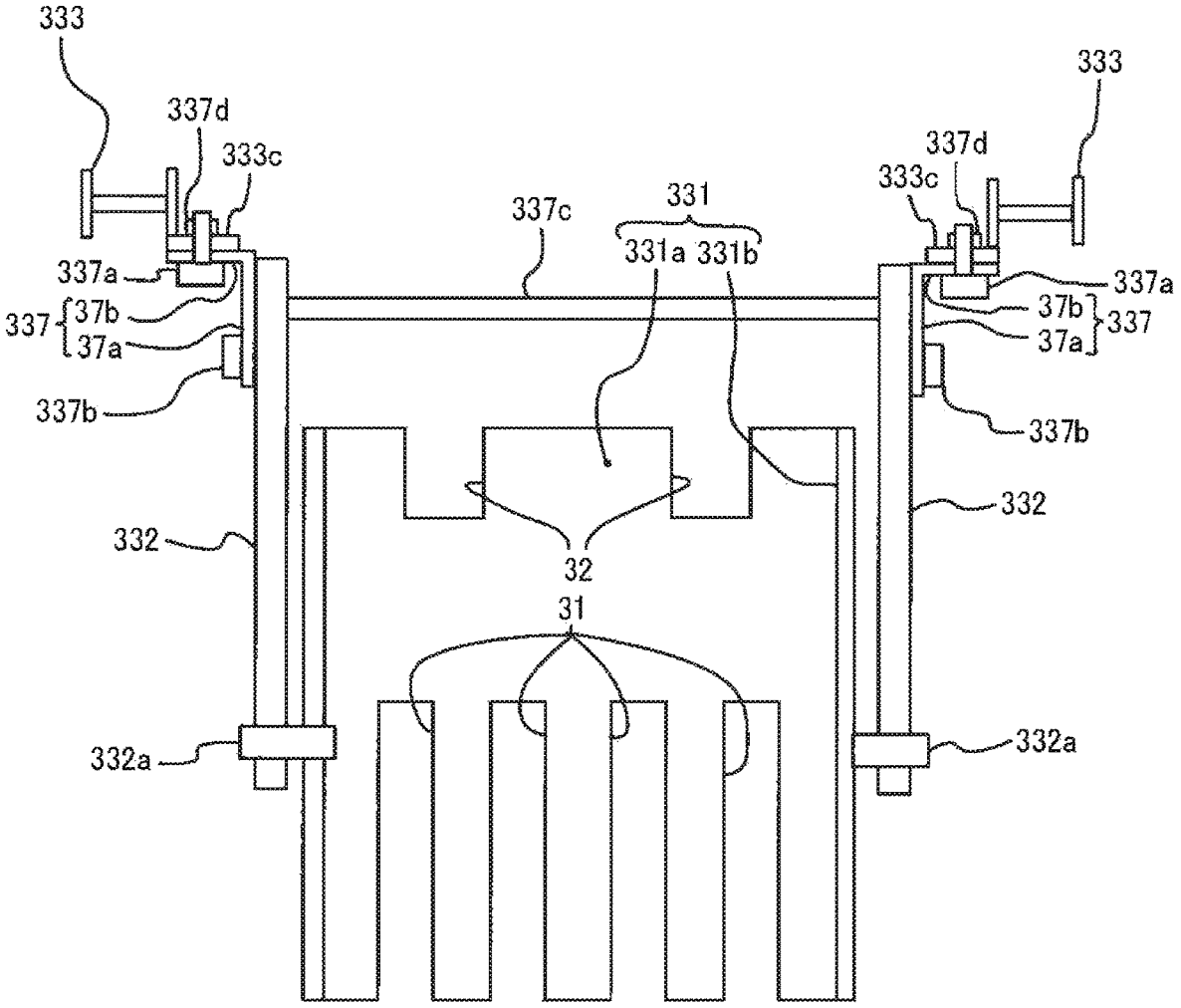
FIG. 6 is a schematic view of the portion of the drying conveyance unit seen from a direction indicated by arrow A in FIG. 5.

FIG. 5 is an enlarged view of a part of the drying conveyance unit 330. FIG. 6 is a schematic view of the part of the drying conveyance unit 330 seen from a direction indicated by arrow A in FIG. 5. As illustrated in FIG. 5, an arm mount member 337 is mounted to the member mount portion 333*c* of each outer link 333*b*. As illustrated in FIG. 6, the arm mount member 337 has a chain mount surface 37*b* parallel to the member mount portion 333*c* and an arm mount surface 37*a* bent 90 degrees from an end of the chain mount surface 37*b* at the drying rack side. The chain mount surface 37*b* of the arm mount member 337 is secured to the member mount portion 333*c* by a bolt 337*a* and a nut 337*d*. As illustrated in FIG. 5, two points, i.e., upper and lower points of the arm 332 are screwed to the arm mount surface 37*a* with screws 337*b*.

The arm 332 extends in the normal direction of the conveyor chain 333 and has a shape in which the width (length in a moving direction of the conveyor chain 333) gradually narrows (shortens) toward the leading end of the arm 332. A shaft 332*a* is mounted on the leading end of the arm 332, and the drying rack 331 is rotatably mounted on the shaft 332*a*. As illustrated in FIG. 6, a connecting member 337*c* to connect the arm 332 on the front side and the arm 332 on the rear side is attached to an end portion on a conveyor chain side of each of the arms 332.

In the present embodiment, the drying rack 331 is coupled to the outer links 333*b* of the conveyor chain 333 via the arms 332, and the interval between the drying racks 331 is 2 L when the chain pitch is L.

The drying rack 331 includes side walls 331*b* and a loading portion 331*a*. The side walls 331*b* are parallel to both the vertical direction and a sheet carry-in direction (indicated by arrow Y1 in FIG. 2) and a sheet carry-out direction (indicated by arrow Y2 in FIG. 2). The loading portion 331*a* is perpendicular to the vertical direction on which the sheet P is placed. A plurality of carry-in-side cutouts 31, which are escape portions to escape the belt carry-in mechanism 322, are disposed at a carry-in-side end (a lower end in FIG. 6) of the loading portion 331*a*. Carry-out-side cutouts 32 to escape the belt carry-out mechanism 341 are disposed at a carry-out-side end (an upper end in FIG. 6) of the loading portion 331*a*.

Figure 7A:
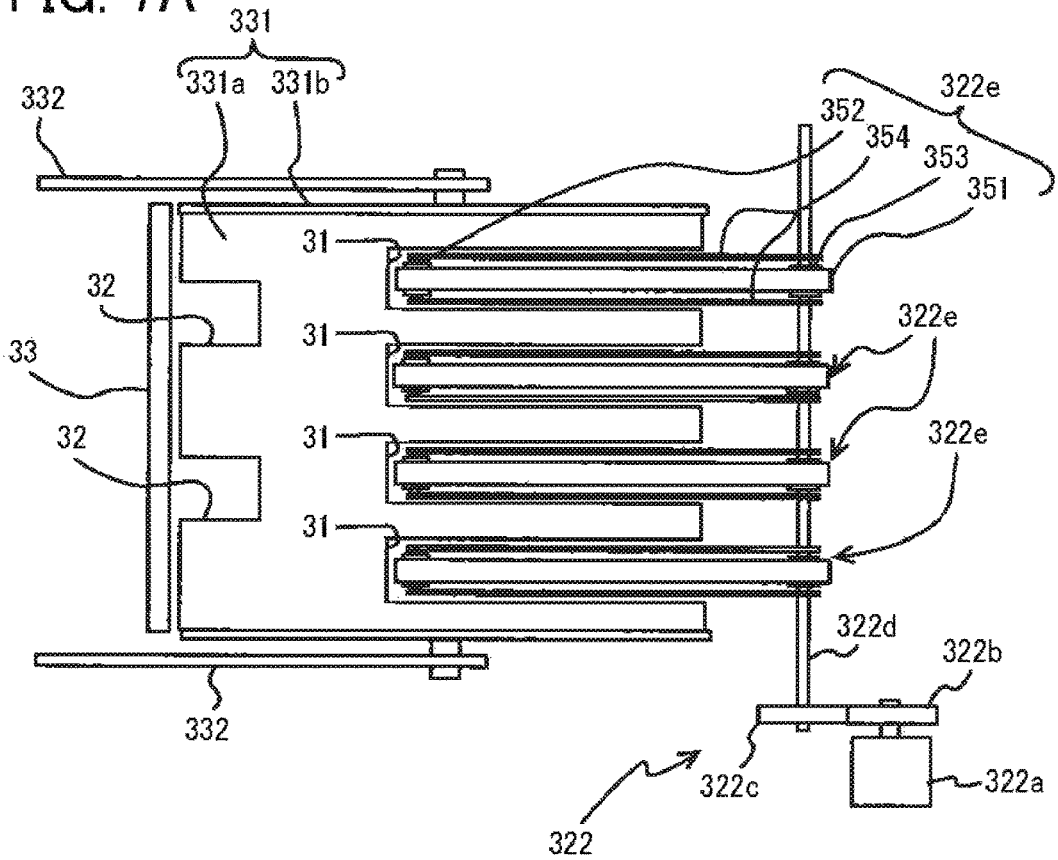
FIGS. 7A and 7B are schematic views of carry-in of a sheet into a drying chamber.
Figure 7B:
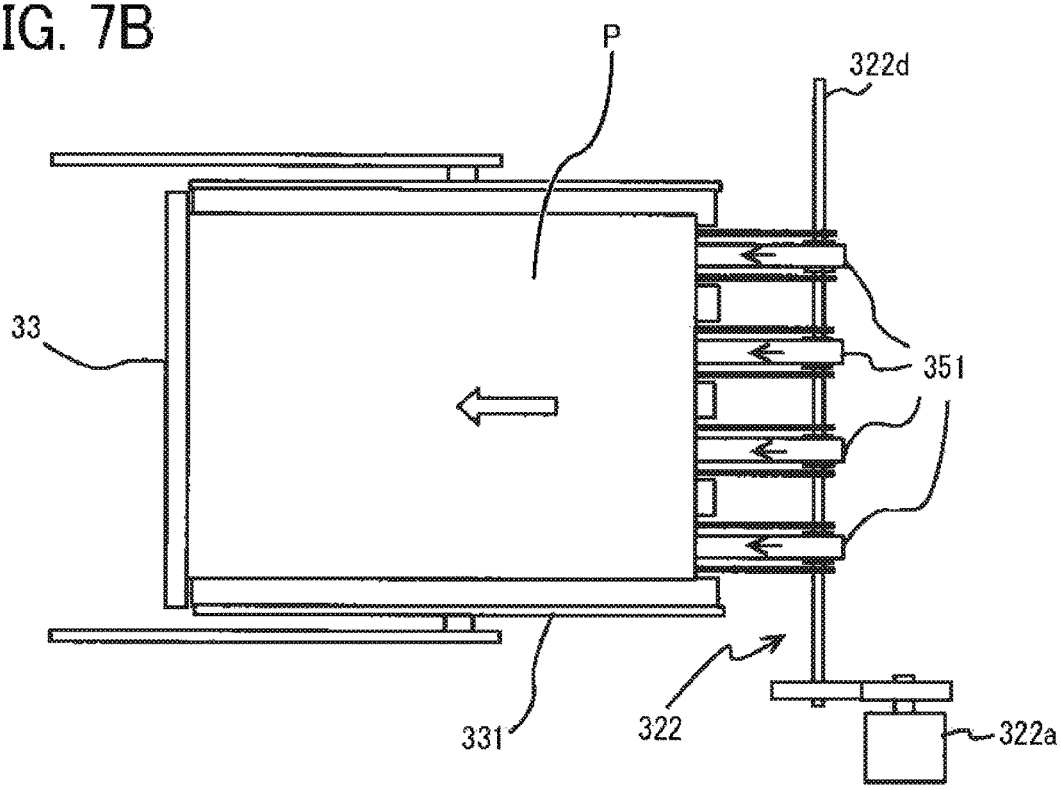

FIGS. 7A and 7B are illustrations of carry-in of the sheet P into the drying chamber. As illustrated in FIG. 7A, the belt carry-in mechanism 322 includes four belt conveyors 322*e* arranged at equal intervals in a sheet width direction (an axial direction of a drive shaft 322*d*). Each belt conveyor 322*e* includes a driving roller 353 mounted on the drive shaft 322*d*, a driven roller 352 rotatably supported by a pair of roller supporting arms 354, a conveying belt 351 stretched around the driving roller 353 and the driven roller 352. The pair of roller supporting arms 354 has one end to rotatably support the driven roller 352 and another end supported by the drive shaft 322*d* via, e.g., a bearing. A gear 322*c* is mounted on one end of the drive shaft 322*d* and is engaged with a drive gear 322*b* of a drive motor 322*a*. In the present embodiment, the driving force of the drive motor 322*a* is transmitted to the drive shaft 322*d* via the gear 322*c*. In some embodiments, a motor shaft of a drive motor and a drive shaft may be coaxially arranged to transmit the drive force of the drive motor to the drive shaft.

The belt carry-out mechanism 341 has a configuration similar to the configuration of the belt carry-in mechanism except that two belt conveyors 322*e* are arranged side by side in the axial direction and the width of a conveying belt 351 is greater than the width of the conveying belt 351 of the belt carry-in mechanism 322.

Examples of material of the conveying belt of the belt carry-in mechanism 322 or the belt carry-out mechanism 341 include metal and rubber, and the material is not limited to any particular material. However, it may be preferable to use a heat-resistant material (heat resistant rubber, metal, or the like) in consideration of being exposed to a high temperature when passing through the inside of the drying chamber 313. Similarly, it is preferable that the driven rollers disposed in the drying chamber 313 or the roller supporting arm 354 partially disposed in the drying chamber 313 is also made of a heat resistant material.

As illustrated in FIG. 7B, when the sheet P is conveyed into the drying chamber 313 by the plurality of belt conveyors 322*e*, a leading end of the sheet P in a sheet conveyance direction of the sheet P hits and is positioned by the sheet stopper 33 in the drying chamber 313. The sheet P is held on the loading portion 331*a* of the drying rack 331 in such a manner as to be scooped up by the drying rack 331, which has passed through the belt conveyors 322*e* of the belt carry-in mechanism 322. The sheet P held in the drying rack 331 is separated from the conveying belt 351 and moves upward in the drying chamber 313.

In the carry-out of the sheet P, when the drying rack 331 passes the belt conveyors of the belt carry-out mechanism 341 from above to below, the leading end side of the sheet P in the sheet carry-out direction Y2 comes into contact with the conveying belts of the belt conveyors. Accordingly, the sheet P is conveyed by the conveying belts and carried out from the drying chamber 313.

In the present embodiment, the sheet P is circulated around the horizontal axis in the drying chamber 313 to dry ink on the image surface of the sheet P. Such a configuration can prevent the drying unit 300 from upsizing in the horizontal direction as compared with a drying unit that moves the sheet P only in the horizontal direction to dry ink on the image surface of the sheet P.

Figure 8:
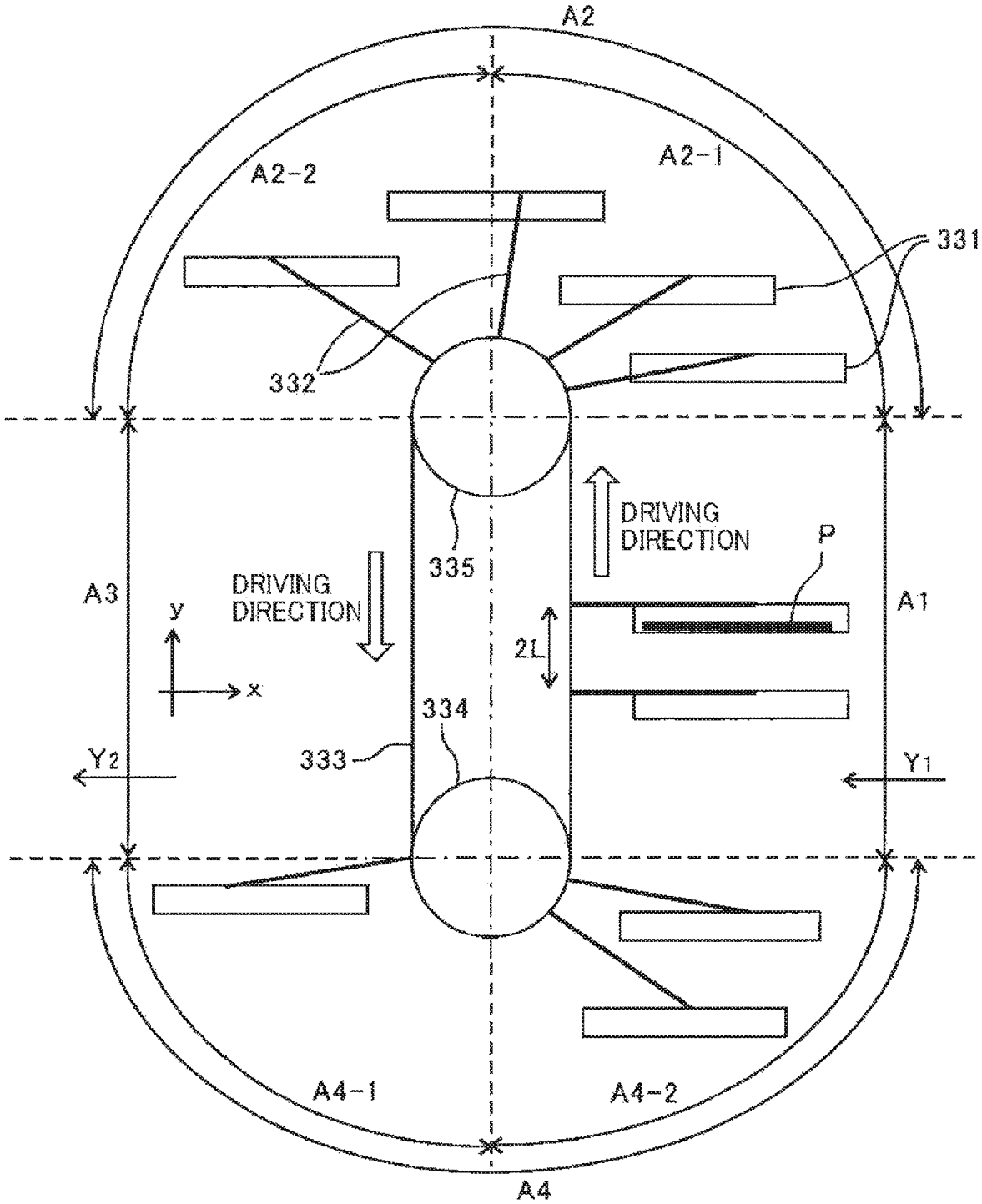
FIG. 8 is an illustration of movement of drying racks.

FIG. 8 is an illustration of movement of the drying rack 331. As illustrated in FIG. 8, the movement of the drying rack 331 can be divided into four regions: an upward movement region A1, a region (hereinafter referred to as first turning region) A2 in which the movement of the drying rack 331 switches from upward movement to downward movement, a downward movement region A3, and a region (hereinafter referred to as second turning region) A4 in which the movement of the drying racks 331 switches from the downward movement to the upward movement. In the first turning region A2, the drying rack 331 moves while drawing a trajectory of a semicircular arc. Therefore, the first turning region A2 can be divided into a sub-region A2-1 in which the drying racks 331 moves in the horizontal direction while moving upward and a sub-region A2-2 in which the drying rack 331 moves in the horizontal direction while moving downward. Similarly, in the second turning region A4, the drying rack 331 moves while drawing a trajectory of a semicircular arc. Therefore, the second turning region A4 can be divided into a sub-region A4-1 in which the drying racks 331 moves in the horizontal direction while moving downward and a sub-region A4-2 in which the drying rack 331 moves in the horizontal direction while moving upward. The sheet P is carried into the upward movement region A1, passes the first turning region A2, and is carried out in the downward movement region A3.

If the drying rack 331 to hold the sheet P is unrotatably fixed to the arms 332, the drying rack 331 would rotate (be reversed) by 180 degrees in the first turning region A2. For example, in the sub-region A2-1 in which the drying rack 331 moves in the horizontal direction while moving upward, the drying rack 331 is gradually raised and is turned upright at a top of the arc-shaped trajectory. In the sub-region A2-2 in which the drying rack 331 moves in the horizontal direction while moving downward, the drying rack 331 is gradually tilted. In the upward movement region A1 in which the drying rack 331 moves upward, an upper end portion of the drying racks 331 at the vertex is placed to a lower end in the downward movement region A3.

If the drying rack 331 to hold the sheet P is unrotatably fixed to the arms 332, the drying rack 331 would be reversed when the drying racks 331 moves from the upward movement region A1 to the downward movement region A3. Therefore, to prevent the sheet P from falling from the drying rack 331 in the sub-region A2-2 in which the drying rack 331 moves in the horizontal direction while moving downward and the downward movement region A3 in which the drying rack 331 moves downward, the loading portion 331*a* to load the sheet P would be needed on both the upper side and the lower side of the drying racks 331. As a result, the image surface of the sheet P is covered to hamper heat from being effectively imparted to ink on the image surface of the sheet P, which might cause drying failure. Further, when the drying rack 331 is reversed (rotated by 180 degrees) in the first turning region A2, the sheet P would buckle or move in the drying rack 331. As a result, the position of the sheet P in the drying rack 331 would be disturbed. Accordingly, in a processing step after the sheet is dried, the sheet would not be conveyed at a prescribed timing, thus causing a failure in which the speed-up of the apparatus cannot be sufficiently achieved.

By contrast, in the present embodiment, the drying rack 331 is rotatably supported by the arms 332. In addition, the loading portion 331*a* side of the drying rack 331 is heavy. Accordingly, the drying rack 331 rotates with respect to the arms 332 so that the loading portion 331*a* is placed lower than the shafts 332*a*. The center of gravity of the drying rack 331 is located at the center of the sheet carry-in direction and the sheet carry-in direction. As a result, the drying rack 331 is rotated with respect to the arm 332 so that the loading portion 331*a* is maintained in a horizontal state. In the first turning region A2, the arms 332 secured to the conveyor chain 333 are reversed. However, the drying rack 331 automatically rotates with respect to the arms 332 by its own weight and the loading portion 331*a* is maintained in a horizontal-state posture. Such a configuration can prevent the sheet P from buckling and moving in the drying rack 331 and reduce the disturbance of the position of the sheet P. Accordingly, the sheet P can be carried out from the drying rack 331 in a state in which the sheet P is positioned at the prescribed position of the drying rack 331, and the sheet P can be conveyed at a prescribed timing in the processing step after drying of the sheet P.

Further, in the present embodiment, the drying rack 331 automatically rotates with respect to the arms 332 by its own weight to maintain the position of the drying rack 331. In some embodiments, a guide mechanism or a driving device may forcefully rotate the drying rack with the circulation of the drying rack, to maintain the posture of the drying rack.

Further, in the first turning region A2, the drying rack 331 can be always held by the loading portion 331*a* without being reversed. Such a configuration can obviate the necessity to provide a surface facing the image surface of the sheet P on the drying rack. Accordingly, it is possible to expose the image surface of the sheet, to favorably impart heat to ink on the image surface of the sheet P, and to favorably dry the ink.

In the present embodiment, the drying rack 331 moves so as to draw a trajectory of a circular arc in the first turning region A2 and the second turning region A4. Accordingly, the drying rack 331 moves in the vertical direction while moving in the horizontal direction in the first turning region A2 and the second turning region A4.

The length of the drying rack 331 in the horizontal direction is longer than the length in the vertical direction. When the drying rack 331 is moved only in the horizontal direction (in this embodiment, the sheet carry-in direction Y1 and the sheet carry-out direction Y2) in each of the first turning region A2 and the second turning region A4, the drying rack 331 needs to move by a distance not less than its own horizontal length (length in the sheet carry-in direction and the sheet carry-out direction) until the next drying rack 331 reaches the first turning region A2 and the second turning region A4, to prevent collision with the next drying rack 331 that moves to the first turning region A2 and the second turning region A4. The interval between the drying racks 331 is preferably narrow since it is possible to narrow the space between sheets in continuous printing and to increase the productivity. The narrow interval between the drying racks 331 is also preferable in that the upward movement and the downward movement of the drying rack 331 can be set to be slow relative to the carry-in speed and the carry-out speed of the sheet P and a sufficient drying time can be obtained with a short moving distance, thus allowing downsizing of the apparatus. However, if the interval between the drying racks 331 is narrow, in a configuration in which the drying rack 331 is moved only in the horizontal direction (in this embodiment, the sheet carry-in direction Y1 and the sheet carry-out direction Y2) in each of the first turning region A2 and the second turning region A4, the moving speed of the drying rack 331 in the first turning region A2 and the second turning region A4 would need to be set to be faster than the moving speed of the drying rack 331 in the upward movement region A1 and the downward movement region A3. Accordingly, when the drying rack 331 enters the first turning region A2 or the second turning region A4, the drying rack 331 would suddenly accelerate. When the drying rack 331 exits from the first turning region A2 or the second turning region A4, the drying rack 331 would suddenly decelerate. As a result, the sheet P held on the drying rack 331 might relatively move with respect to the drying rack 331 on the sudden acceleration and sudden deceleration by the law of inertia and disturb the position of the sheet P in the drying rack 331. In addition, the moving speed of the drying rack 331 in each of the first turning region A2 and the second turning region A4 would be greatly different from the moving speed of the drying rack 331 in each of the upward movement region A1 and the downward movement region A3. Accordingly, it would be difficult to perform the movement of the drying rack 331 in each of the first turning region A2 and the second turning region A4 and the movement of the drying rack 331 in each of the upward movement region A1 and the downward movement region A3 with the same driving mechanism. Therefore, it would be necessary to provide a mechanism for moving the drying rack 331 in the horizontal direction in each of the first turning region A2 and the second turning region A4 and a mechanism for moving the drying rack 331 in the vertical direction in each of the upward movement region A1 and the downward movement region A3 separately from each other, thus increasing the cost of the apparatus.

However, in the present embodiment, by moving the drying rack 331 so as to take the trajectory of the circular arc around the horizontal axis in the first turning region A2 and the second turning region A4, the drying rack 331 moves in the vertical direction while moving in the horizontal direction in each of the first turning region A2 and the second turning region A4. Accordingly, the drying rack 331 moves in the vertical direction before the next drying rack 331 enters the first turning region A2 or the second turning region A4, thus preventing the drying racks 331 from colliding with each other even if the drying rack 331 does not greatly move in the horizontal direction. As a result, even if the interval of the drying racks 331 is narrow, there is no need to move the drying rack 331 in the horizontal direction at high speed in the first turning region A2 and the second turning region A4, thus obviating the need to suddenly accelerate or decelerate the drying rack 331 in the first turning region A2 and the second turning region A4. Such a configuration can suppress the movement of the sheet P held on the drying rack 331, thus reducing the disturbance of the position of the sheet P in the drying rack 331. In addition, a relatively narrow interval between the drying racks 331 can be set, thus shortening the interval between sheets in continuous printing and increasing the productivity. Further, since the interval between the drying racks 331 can be narrowed, the moving speed of the drying rack 331 can be set to be slow relative to the carry-in speed and the carry-out speed of the sheet P. Even if the circulation distance of the drying rack 331 is relatively short, the sheet P can be stayed in the drying chamber for a relatively long time. Such a configuration can downsize the drying unit 300 and favorably dry ink on the image surface of the sheet P. By mounting the drying rack 331 to a rotary driver, such as the conveyor chain 333, which is driven to rotate, the drying rack 331 can be circulated around by a single driving mechanism, thus reducing the cost of the apparatus.

The diameters of the drive gear 335 and the driven gear 334 are preferably small. In the present embodiment, the arc trajectory of the drying rack 331 in each of the first turning region A2 and the second turning region A4 is semicircular. Accordingly, near the top of the arc trajectory (in the vicinity where the movement of the drying rack 331 in the vertical direction is switched), the amount of movement of the drying rack 331 in the vertical direction during movement of a certain distance is smaller than the amount of movement in the vertical direction when the drying rack 331 starts to enter the first turning region A2 or the second turning region A4 or before the drying rack 331 exits the first turning region A2 or the second turning region A4. As the diameters of the driving gear 335 and the driven gear 334 are larger, the curvature of the arc trajectory of the drying rack 331 in each of the first turning region A2 and the second turning region A4 is smaller. As a result, near the top of the arc trajectory, the amount of movement of the drying rack 331 in the vertical direction during movement of a certain distance becomes smaller and smaller. Accordingly, if the mount pitch of the arms 332 to the conveyor chain 333 is narrow, the drying rack 331 might collide with an adjacent drying rack 331 near the top of the arc trajectory.

By contrast, decreasing the diameters of the driving gear 335 and the driven gear 334 can increase the curvature of the arc trajectory of the drying rack 331 in each of the first turning region A2 and the second turning region A4, thus increasing the amount of movement of the drying rack 331 in the vertical direction near the top of the arc trajectory during movement of the conveyor chain 333 by a certain distance. Accordingly, even if the mount pitch of the arms 332 to the conveyor chain 333 is narrow, such a configuration can reduce collision of the adjacent drying racks 331 in the vertical direction near the top of the arc trajectory. Thus, the interval between sheets in continuous printing can be more narrowed, thus allowing further enhancement of the productivity.

Mounting the drying rack 331 to the conveyor chain 333 with the arms 332 can prevent a drying rack 331 moving upward from colliding with another drying rack 331 moving downward even if the diameter of the driving gear 335 or the driven gear 334 is set to be relatively small.

In the present embodiment, as illustrated in FIG. 2, the non-contact heat source unit 311 including the plurality of infrared heaters 311*a* is disposed above the drying conveyance unit 330. Such a configuration can directly apply the radiant heat of the infrared heaters 311*a* to the image surface of the sheet P in the first turning region A2, thus allowing ink of an image on the sheet P to be favorably dried.

Figure 9:
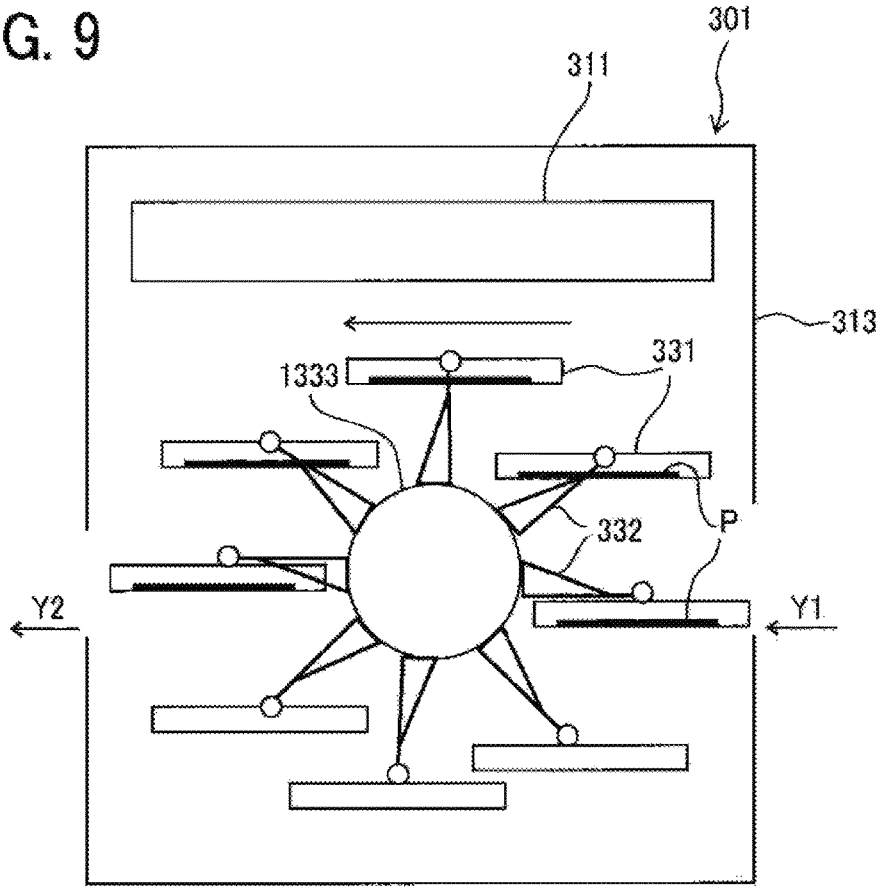
FIG. 9 is a schematic view of an example in which drying racks are circulated around a horizontal axis by a roller member.

In the present embodiment, the drying rack 331 is circulated around the horizontal axis by the conveyor chain 333. In some embodiments, for example, the drying rack 331 may be circulated around the horizontal axis by an endless member, such as a wire or a belt. Alternatively, as illustrated in FIG. 9, the drying rack 331 may be circulated around the horizontal axis by a roller 1333.

Figure 10:
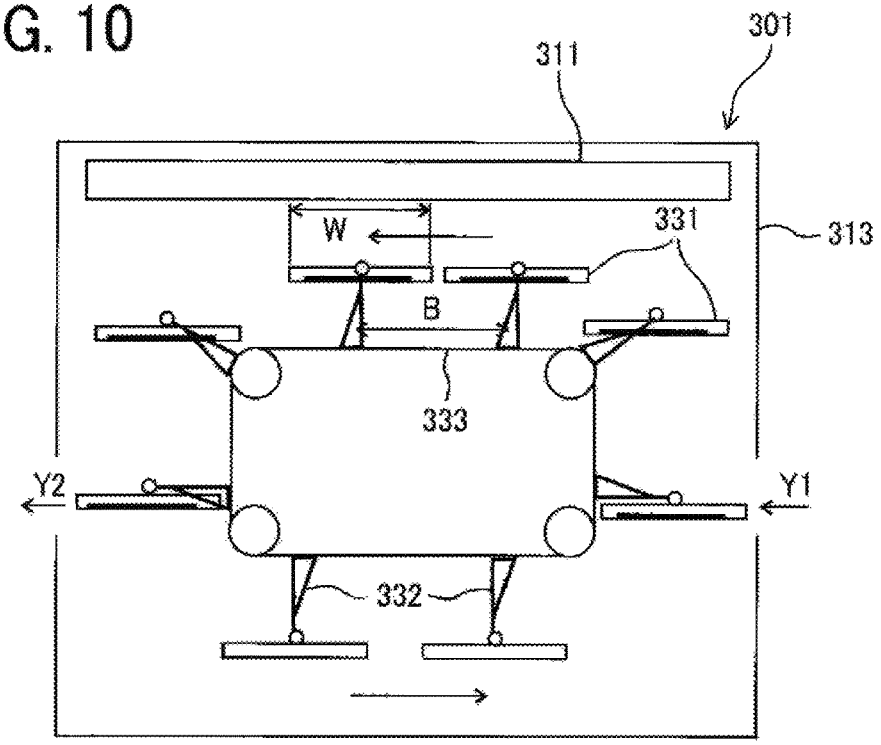
FIG. 10 is a schematic view of an example in which a region is provided in which the drying racks move only in a horizontal direction.

In some embodiments, as illustrated in FIG. 10, an area in which the drying rack 331 moves only in the horizontal direction may be provided. Also in the configuration illustrated in FIG. 10, the arms 332 rotatably support the drying rack 331, thus allowing the drying racks 331 to move within the drying chamber 313 with the posture of the drying racks 331 maintained.

In the configuration illustrated in FIG. 10, to prevent the drying rack 331 from colliding with the adjacent drying rack 331 in regions in which the drying rack 331 moves only in the horizontal direction, the interval B between the arms 332 is set to be not less than the length W of the drying rack 331 in the sheet carry-in direction Y1 and the sheet carry-out direction Y2. Therefore, there is a disadvantage that the interval between the drying racks 331 becomes wider than the interval in the configuration of FIG. 2. However, in FIG.

10, an area in which the image surface of the sheet P faces the non-contact heat source unit 311 can be set to be longer than the configuration illustrated in FIG. 2. Such a configuration can increase an area in which the radiant heat of the infrared heaters can be directly applied to an image formed surface of the sheet P, and there is an advantage that ink of the image on the sheet P can be favorably dried.

In the present embodiment, each arm 332 rotatably supports the drying rack 331 in the center of the drying racks 331 in the sheet carry-in direction Y1 and the sheet carry-out direction Y2 so that the drying rack 331 is rotatably supported by the arms 332 in a horizontal posture and the center of gravity of the drying racks 331 is placed in the center of the drying rack 331 in the sheet carry-in direction Y1 and the sheet carry-out direction Y2. However, when an impact or vibration occurs in the inkjet recording apparatus 1, the drying rack 331 might swing to move the sheet P held on the drying rack 331, thus disturbing the position of the sheet P. Therefore, the drying racks 331 are preferably guided so that the drying racks 331 move while maintaining the horizontal posture. The horizontal posture used herein means a posture of the drying rack 331 in which the loading portion 331*a* of the drying rack 331 is parallel to the horizontal direction.

Figure 11A:
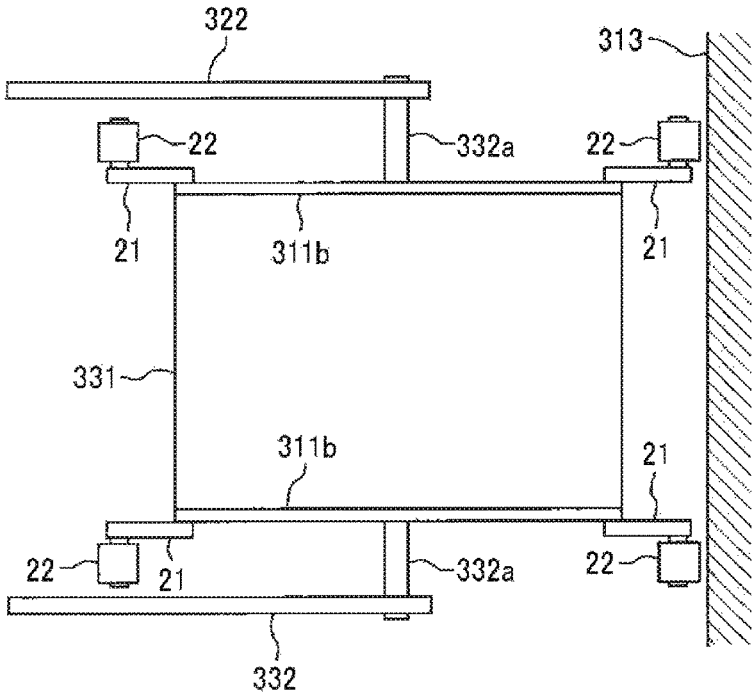
FIGS. 11A and 11B are illustrations of an example of a guide assembly.
Figure 11B:
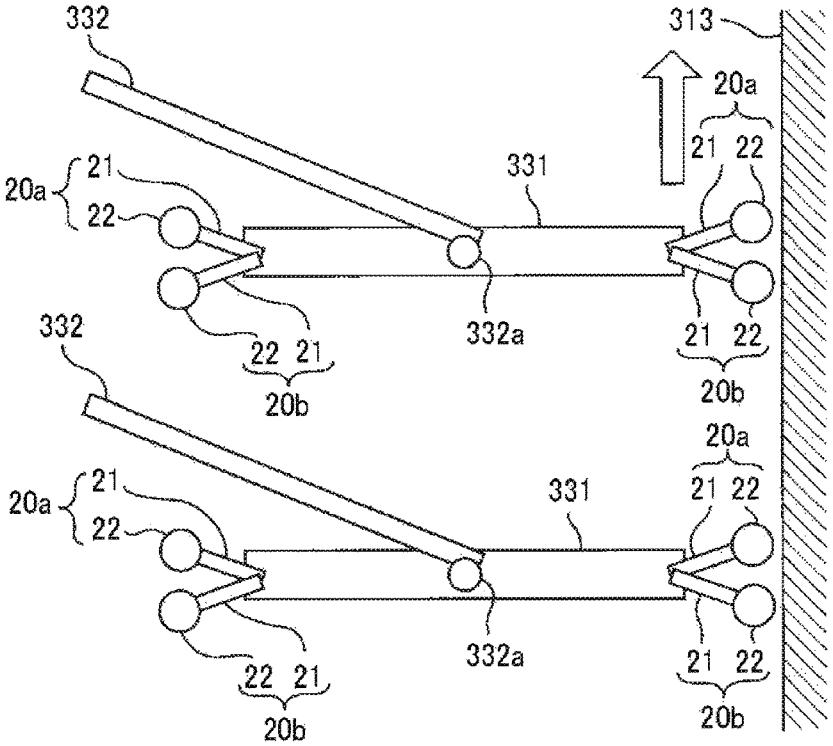

FIGS. 11A and 11B are schematic views of an example of a guide mechanism as a guide unit. FIG. 11A is a plan view of the guide mechanism. FIG. 11B is a side view of the guide mechanism of FIG. 11A. As illustrated in FIGS. 11A and 11B, a pair of guide members 20*a* and 20*b* (upper guide member 20*a* and lower guide member 20*b*) are disposed at each end of each side wall 331*b* of the drying rack 331 in the sheet carry-in direction Y1 and the sheet carry-out direction Y2. Each of the guide members 20*a* and 20*b* includes a guide arm 21 and a guide roller 22. The side wall 331*b* of the drying rack 331 is mounted to one end of the guide arm 21. The guide roller 22 is mounted to another end of the guide arm 21.

As illustrated in FIG. 11B, in the upward movement region A1 where the drying rack 331 moves upward, the guide rollers 22 of the pair of guide members 20*a* mounted to a carry-in-side end of each side wall 331*b* faces a side face of the drying chamber 313. When the drying rack 331 is in the horizontal posture, each of the guide rollers 22 is placed away from the side face of the drying chamber 313, and a slight gap exists between each guide roller 22 and the side face of the drying chamber 313.

In the upward movement region A1 where the drying rack 331 moves upward, the guide rollers 22 of the upper guide member 20*a* of the pair of guide members 20*a* and 20*b* on the sheet carry-in side (the right side in FIG. 11B) contact the side face of the drying chamber 313, thus preventing the drying rack 331 from rotating clockwise in FIG. 11B. The guide rollers 22 of the lower guide member 20*b* of the pair of guide members 20*a* and 20*b* contact the side face of the drying chamber 313, thus preventing the drying rack 331 from rotating counterclockwise in FIG. 11B. Accordingly, in the upward movement region A1 where the drying rack 331 moves upward, the drying rack 331 can move upward while maintaining the horizontal posture. Therefore, even if an impact or vibration occurs in the inkjet recording apparatus 1, such a configuration can suppress swinging of the drying rack 331 in the upward movement region A1 in which the drying rack 331 moves upward, thus reducing the movement of the sheet P in the upward movement region A1.

On the other hand, in the downward movement region A3 in which the drying rack 331 moves downward, the guide rollers 22 of the lower guide member 20*b* of the pair of guide members 20*a* and 20*b* on the sheet carry-out side (left side in FIG. 11B) contact the side face of the drying chamber 313, thus preventing the drying rack 331 from rotating clockwise in FIG. 11B. The guide rollers 22 of the upper guide member 20*a* of the pair of guide members 20*a* and 20*b* contact another side face of the drying chamber 313, thus preventing the drying rack 331 from rotating counterclockwise in FIG. 11B. Accordingly, in the downward movement region A3 in which the drying rack 331 moves downward, the drying rack 331 can move downward while maintaining the horizontal posture. Therefore, even if an impact or vibration occurs in the inkjet recording apparatus 1, such a configuration can suppress swinging of the drying rack 331 in the downward movement region A3 in which the drying rack 331 moves downward, thus reducing the movement of the sheet P in the downward movement region A3.

In the above description, the guide rollers 22 are separated from the side face of the drying chamber 313 when the drying rack 331 is in the horizontal posture. In some embodiments, the guide rollers 22 may be configured to contact the side face of the drying chamber 313 when the drying rack 331 is in the horizontal posture.

Figure 12:
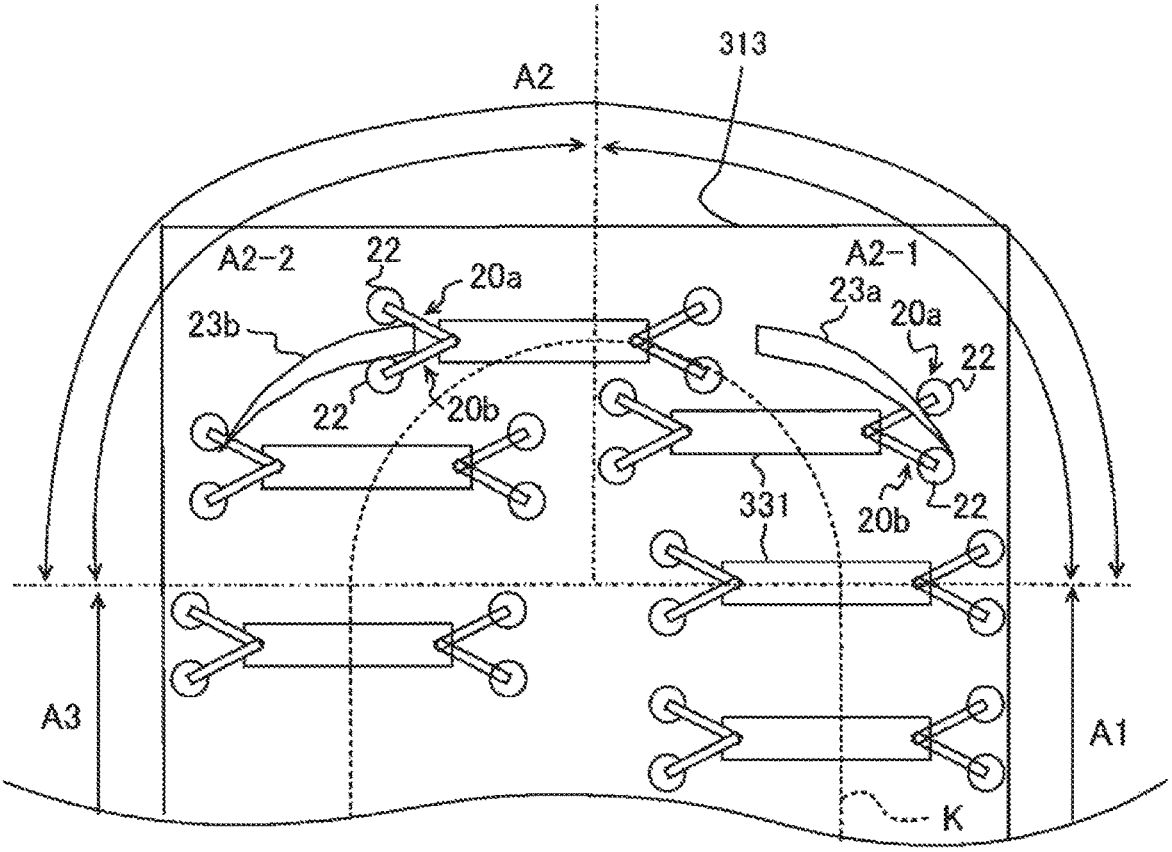
FIG. 12 is a schematic view of an example of guide of drying racks in a first turning region.

FIG. 12 is a schematic view of an example of guide of the drying rack in the first turning region A2. A broken line K in FIG. 12 indicates a movement trajectory of the drying rack 331. As illustrated in FIG. 12, a first turning guide 23*a* is disposed in the sub-region A2-1 of the first turning region A2 in which the drying racks 331 move in the horizontal direction while moving upward. A second turning guide 23*b* is disposed in the sub-region A2-2 of the first turning region A2 in which the drying rack 331 moves in the horizontal direction while moving downward.

The first turning guide 23*a* and the second turning guide 23*b* are disposed on each side in the depth direction of the inkjet recording apparatus 1 (a direction orthogonal to a surface of a sheet on which FIG. 12 is printed). The first turning guide 23*a* and the second turning guide 23*b* on the rear side of the inkjet recording apparatus 1 guide the pair of guide members 20*a* and 20*b* on the rear side of the inkjet recording apparatus 1. The first turning guide 23*a* and the second turning guide 23*b* on the front side of the inkjet recording apparatus 1 guide the pair of guide members 20*a* and 20*b* on the front side of the inkjet recording apparatus 1.

The first turning guide 23*a* has a substantially arcuate shape and has a shape in which the thickness gradually increases toward the downstream side in the moving direction of the drying rack 331. The second turning guide 23*b* also has a substantially arcuate shape. However, unlike the first turning guide 23*a*, the thickness of the second turning guide 23*b* gradually decreases toward the downstream side in the moving direction of the drying rack 331.

In the sub-region A2-1 in which the drying rack 331 moves in the horizontal direction while moving upward, the guide rollers 22 of the upper guide member 20*a* of the pair of guide members 20*a* and 20*b* on the sheet carry-in side (right side in FIG. 12) are guided by an upper surface of the first turning guide 23*a*. Further, the guide rollers 22 of the lower guide member 20*b* are guided by a lower surface of the first turning guide 23*a*. As described above, in the sub-region A2-1, the drying rack 331 moves in a manner that the first turning guide 23*a* is sandwiched by the pair of guide members 20*a* and 20*b* on the sheet carry-in side. Accordingly, in the sub-region A2-1, the guide rollers 22 of the upper guide member 20*a* of the pair of guide members 20*a* and 20*b* on the sheet carry-in side contact the upper surface of the first turning guide 23*a*, thus preventing the drying rack 331 from rotating clockwise in FIG. 12. The guide rollers 22 of the lower guide member 20*b* of the pair of guide members 20*a* and 20*b* on the sheet carry-in side contact the lower surface of the first turning guide 23*a*, thus preventing the drying rack 331 from rotating counterclockwise in FIG. 12. Therefore, even if an impact or vibration occurs in the inkjet recording apparatus 1, such a configuration can suppress swinging of the drying rack 331 in the sub-region A2-1, thus reducing the movement of the sheet P in the sub-region A2-1.

In the sub-region A2-2 in which the drying rack 331 moves in the horizontal direction while moving downward, the guide rollers 22 of the upper guide member 20*a* of the pair of guide members 20*a* and 20*b* on the sheet carry-out side (left side in FIG. 12) are guided by an upper surface of the first turning guide 23*a*. Further, the guide rollers 22 of the lower guide member 20*b* are guided by a lower surface of the second turning guide 23*b*. As described above, in the sub-region A2-2, the drying rack 331 moves in a manner that the second turning guide 23*b* is sandwiched by the pair of guide members 20*a* and 20*b* on the sheet carry-out side. Accordingly, in the sub-region A2-2, the guide rollers 22 of the lower guide member 20*b* of the pair of guide members 20*a* and 20*b* on the sheet carry-out side contact the lower surface of the second turning guide 23*b*, thus preventing the drying rack 331 from rotating clockwise in FIG. 12. In addition, the guide rollers 22 of the lower guide member 20*b* of the pair of guide members 20*a* and 20*b* on the sheet carry-out side contact the upper surface of the second turning guide 23*b*, thus preventing the drying rack 331 from rotating counterclockwise in FIG. 12. Therefore, even if an impact or vibration occurs in the inkjet recording apparatus 1, such a configuration can suppress swinging of the drying rack 331 in the sub-region A2-2, thus reducing the movement of the sheet P in the sub-region A2-2.

As described above, in the upward movement region A1, the first turning region A2, and the downward movement region A3, the drying rack 331 can move while maintaining the horizontal posture. Therefore, even when an impact or vibration occurs in the inkjet recording apparatus 1, such a configuration can suppress swinging of the drying rack 331 holding the sheet P, thus reducing the movement of the sheet Pin the drying rack 331. Accordingly, such a configuration can prevent the position of the sheet P on the drying rack 331 from deviating from the prescribed position, thus allowing the sheet P to be conveyed at a prescribed timing in the processing step after drying of the sheet P. As a result, the speed-up of the inkjet recording apparatus 1 can be achieved.

In addition, the center of gravity of the drying rack 331 might deviate from the center of the drying rack 331 in the sheet carry-in direction Y1 and the sheet carry-out direction Y2 due to, e.g., manufacturing error. In such a case, the drying rack 331 might be supported by the arms 332 in a posture inclined with respect to the horizontal direction. As a result, the sheet P held on the drying rack 331 in the inclined posture might move in the inclination direction of the drying rack 331 during movement in the drying chamber 313 and deviate from the prescribed position. Therefore, a center-of-gravity adjuster is preferably disposed on the drying rack 331.

Figure 13:
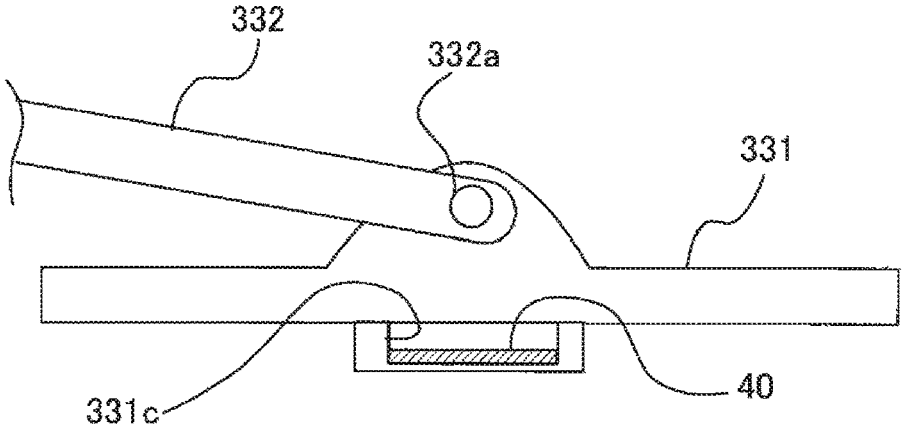
FIG. 13 is a schematic view of an example in which a center-of-gravity adjuster is provided on a drying rack.

FIG. 13 is a schematic view of an example in which the center-of-gravity adjuster is provided on the drying rack. As illustrated in FIG. 13, the center-of-gravity adjuster includes a weight 40 and a holding portion 331*c* to hold the weight 40 and is disposed at the center of the lower surface of the loading portion 331*a* of the drying rack 331 in the sheet carry-in direction Y1 and the sheet carry-out direction Y2. The holding portion 331*c* includes a rectangular hole. By inserting the weight 40 into the rectangular hole, the center of gravity of the drying rack 331 can be reliably guided to a target position that is at the center in the sheet carry-in direction Y1 and the sheet carry-out direction Y2 and lower than a support position at which the drying rack 331 is supported by the arms 332. Such a configuration allows the drying rack 331 to be reliably maintained in the horizontal posture. Accordingly, such a configuration can prevent the sheet P from moving relative to the drying rack 331 during movement of the drying rack 331 in the drying chamber 313 and deviating from the prescribed position. Note that the holding portion 331*c* may be disposed at any position at which the drying rack 331 can be maintained in the horizontal posture.

In some embodiments, ink on the image surface of the sheet P may be dried by radiant heat of the non-contact heat source unit 311 and hot air.

Figure 14:
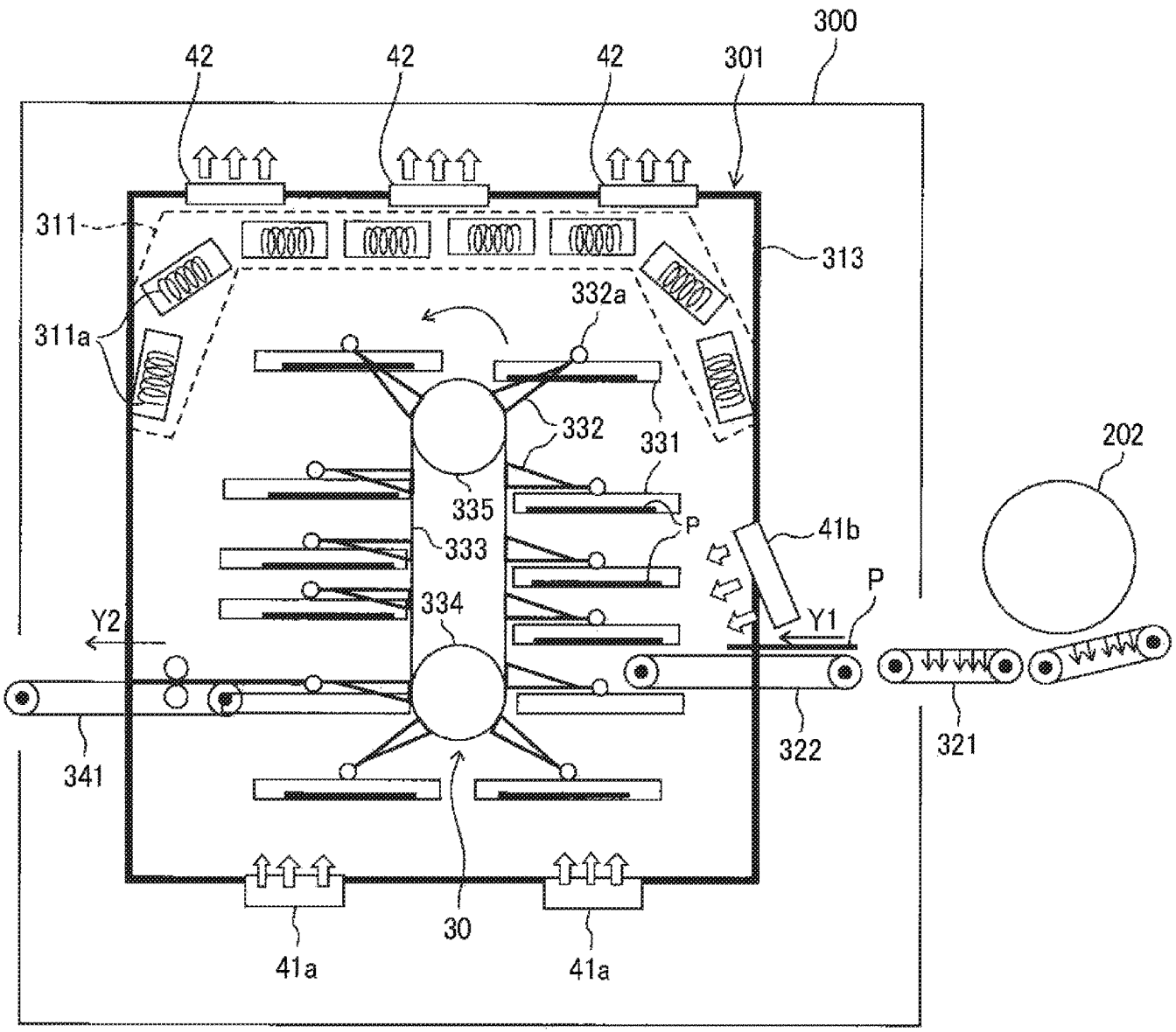
FIG. 14 is a schematic view of an example of a drying assembly configured to dry ink on an image surface of a sheet by radiant heat of a non-contact heat source unit and hot air.

FIG. 14 is a schematic view of an example of the drying assembly 301 configured to dry ink on the image surface of the sheet P by radiant heat of the non-contact heat source unit 311 and hot air. As illustrated in FIG. 14, a plurality of first blowing fans 41*a* to blow hot air at 100° C. to 140° C. are disposed below the drying assembly 301. A plurality of second blowing fans 41*b* are disposed to blow hot air at 100° C. to 140° C. onto the sheet P conveyed into the drying chamber 313 by the belt carry-in mechanism 322. A plurality of exhaust ports 42 to exhaust air from the drying chamber 313 are disposed on an upper surface of a heating section 301*a*.

Ink on the image surface of the sheet P held on the drying rack 331 is dried by the radiant heat of the non-contact heat source unit 311 and the hot air sent by the blowing fans 41*a* and 41*b*. Such a configuration can more favorably dry the ink on the image surface of the sheet P than a configuration in which the ink on the image surface of the sheet P is dried only by the radiant heat of the non-contact heat source unit 311.

In addition, in the drying chamber 313, low temperature air tends to accumulate in the lower side, and high temperature air tends to stay in the upper side, so that a temperature deviation is likely to occur in the drying chamber 313. Accordingly, if the first blowing fan 41*a* to blow hot air is not located at the lower side, low temperature air would accumulate in the lower side. Also, if no exhaust port is located at the upper side, hot air would accumulate in the upper side. However, in the present embodiment, the first blowing fan 41*a* to blow hot air is disposed at the lower side and the exhaust ports 42 are disposed in the upper side, thus suppressing the accumulation of low temperature air in the lower side and high temperature air in the upper side. Such a configuration can even the temperature distribution in the drying chamber 313.

By providing the exhaust ports 42, moisture and solvent evaporated from ink in the drying chamber 313 can be exhausted from the exhaust ports 42, thus maintaining the interior of the drying chamber 313 in a dry state. High temperature air containing the moisture and solvent evaporated from the ink are likely to rise and accumulate on the upper side of the drying chamber 313. Therefore, providing the exhaust ports 42 on the upper wall of the drying chamber 313 allows effective exhaust of the moisture and solvent evaporated from the ink.

Next, a variation of the drying assembly 301 is described below.

Figure 15:
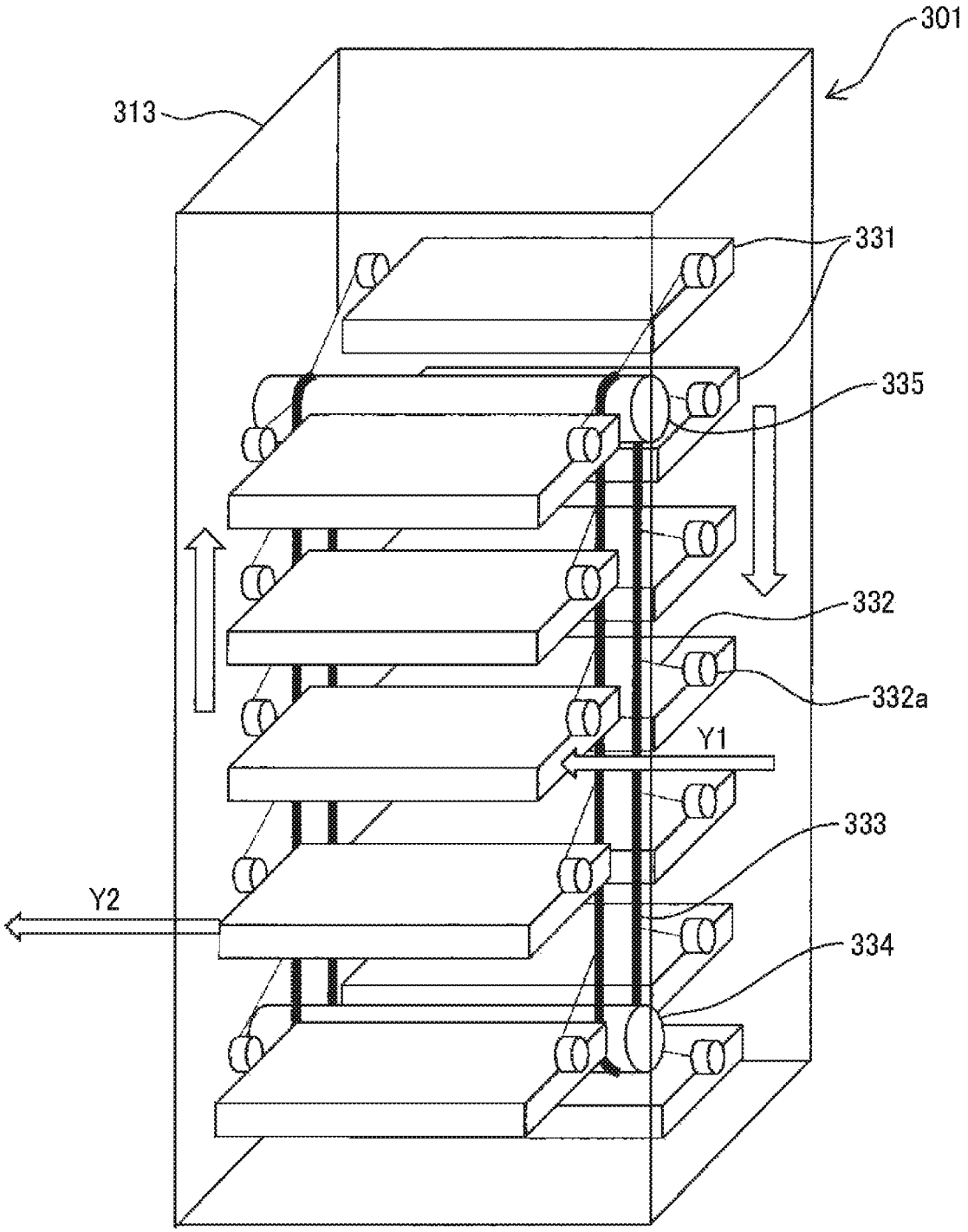
FIG. 15 is a schematic perspective view of a variation of the drying assembly.
Figure 16:
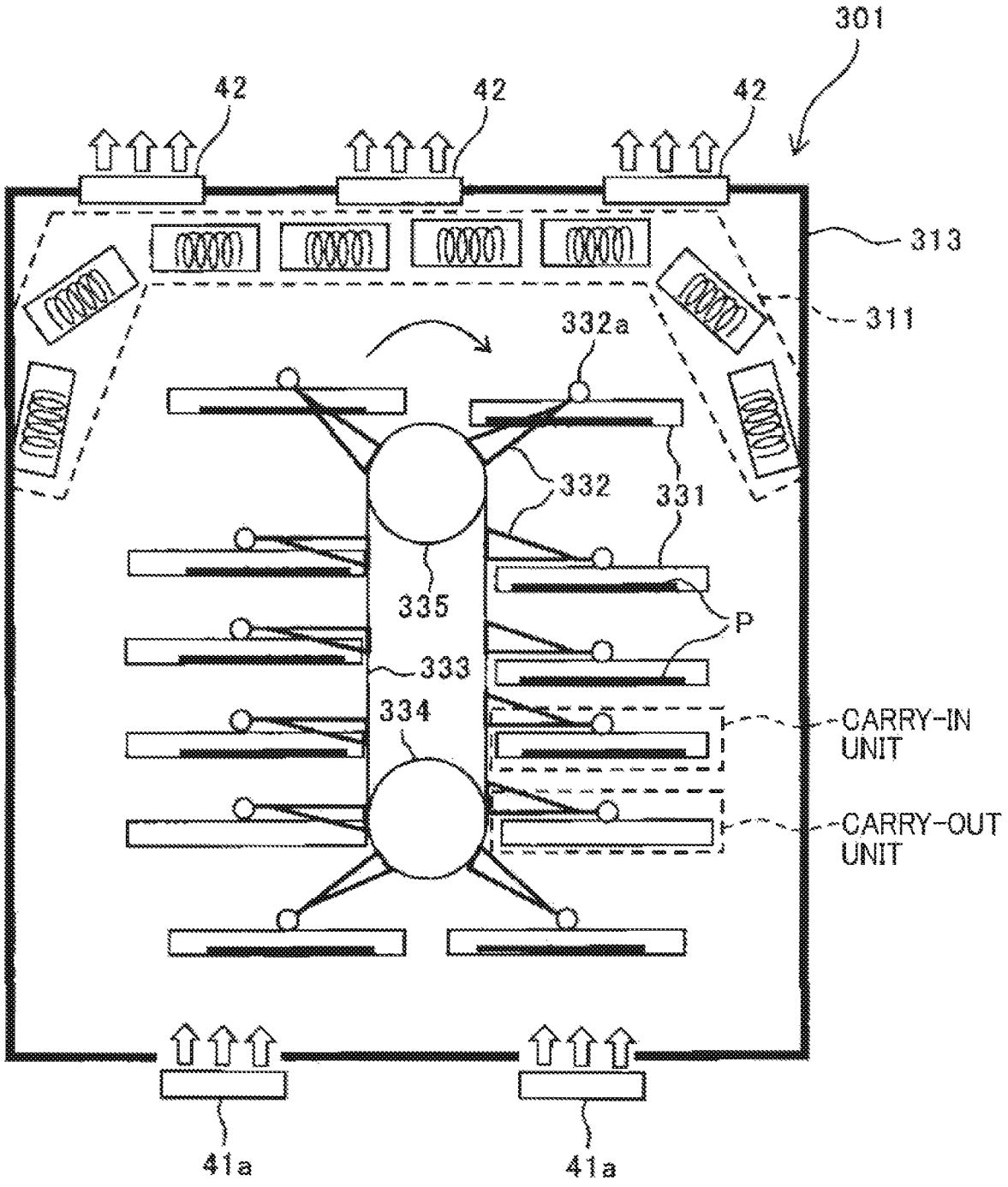
FIG. 16 is a schematic view of the variation of the drying assembly seen from a sheet carry-in and carry-out direction.

FIG. 15 is a schematic perspective view of a first variation of the drying assembly. FIG. 16 is a schematic view of the first variation of the drying assembly seen from the sheet carry-in direction Y1 (or the sheet carry-out direction Y2). As illustrated in FIG. 15 and FIG. 16, the drying assembly 301 of the first variation circulates the drying racks 331 around the axis parallel to the sheet carry-in direction Y1 and the sheet carry-out direction Y2. In a configuration in which a sheet P is carried in from one side face of the drying chamber 313 and carried out from the opposite side face and the drying racks 331 are circulated around the axis orthogonal to the sheet carry-in direction Y1 and the sheet carry-out direction Y2, the sheet carry-in position and the sheet carry-out position are as follows. That is, the sheet carry-in position is disposed in the upward movement region A1 in which the drying racks 331 move upward, and the sheet carry-out position is disposed in the upward movement region A3 in which the drying racks 331 move downward. Accordingly, in the configuration illustrated in FIG. 2, the second turning region A4, in which the movement of the drying rack 331 switches from the downward movement to the upward movement, is not used for drying ink on the image surface of the sheet P.

Further, in the configuration illustrated in FIG. 2, since two drying racks 331 are arranged in the sheet carry-in direction Y1 and the sheet carry-out direction Y2, the size of the drying assembly 301 is likely to increase in the sheet carry-in direction Y1 and the sheet carry-out direction Y2.

In the present variation, as illustrated in FIG. 15, the sheet carry-in position and the sheet carry-out position can be set in the upward movement region A1 in which the drying racks 331 move upward. Accordingly, in the drying chamber 313, the sheet P held on the drying rack 331 can be carried out after almost one turn and all of the movement regions A1 to A4 can be used to dry the ink on the image surface of the sheet P. Such a configuration allows the ink on the image surface of the sheet P to be favorably dried.

Further, in the present variation, since a single drying rack 331 is arranged in the sheet carry-in direction Y1 and the sheet carry-out direction Y2, the size of the drying assembly 301 can be smaller in the sheet carry-in direction Y1 and the sheet carry-out direction Y2 than the above-described configuration illustrated in FIG. 2. In addition, in the present variation, the drying racks 331 are arranged in the depth direction of the inkjet recording apparatus 1, so that the size of the drying unit 300 is likely to be larger in the depth direction than the configuration illustrated in FIG. 2. However, in the depth direction of the image forming unit 200, for example, an electrical component, such as a driving device to drive conveyance members, such as the pair of registration rollers 130, to convey a sheet is disposed on the rear side of the ink discharge unit 220. Accordingly, the inkjet recording apparatus 1 has a certain length in the depth direction. Therefore, the upsizing of the drying assembly 301 in the depth direction less influences the entire size of the inkjet recording apparatus 1.

Figure 17A:
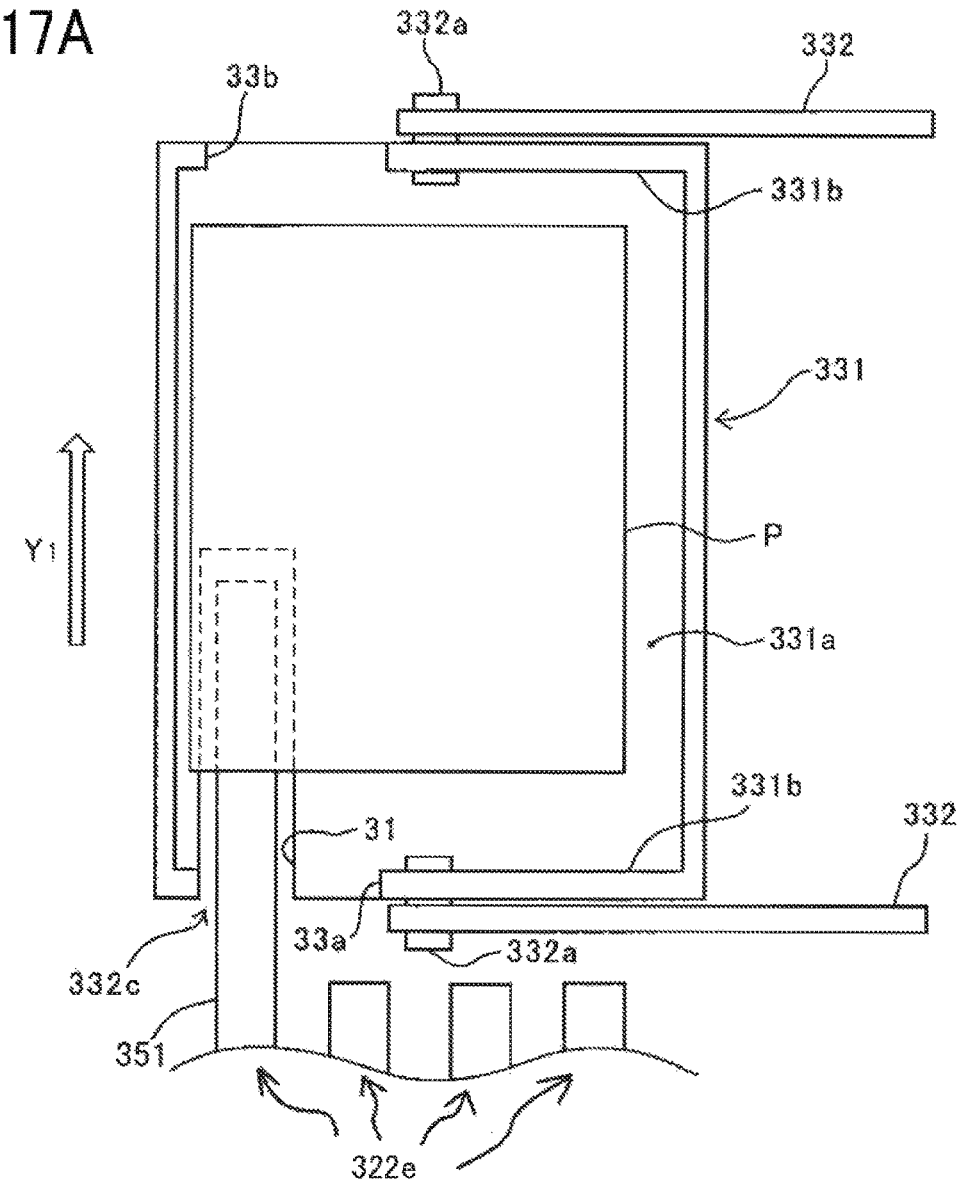
FIGS. 17A and 17B are schematic views of carry-in of a sheet in the variation of the drying assembly.
Figure 17B:
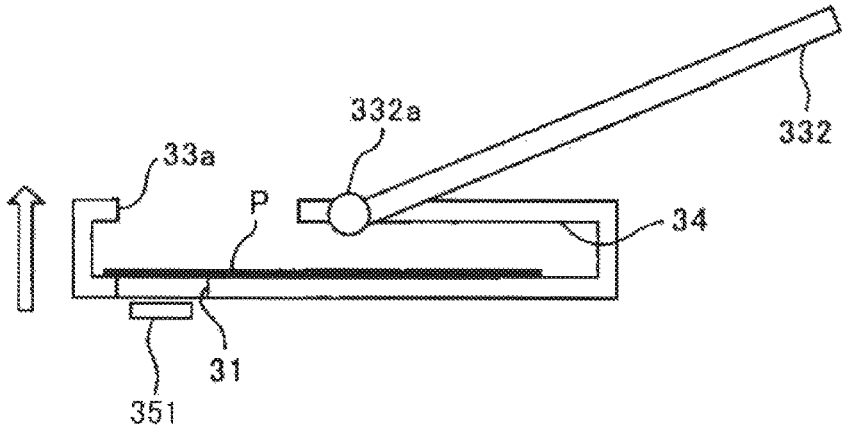

FIGS. 17A and 17B are schematic views of carry-in of the sheet in the drying assembly 301 in the variation. FIG. 17A is a schematic plan view of the drying assembly 301. FIG. 17B is a schematic view of the drying assembly 301 seen from the sheet carry-in direction. In the present variation, the sheet P is carried in from one of the side walls 331*b* of the drying rack 331 supported by the arms 332 and is carried out from the other of the side walls 331*b*. Accordingly, as illustrated in FIG. 17B, each of the side walls 331*b* includes a rectangular opening 34.

A cutout 33*a* through which the belt carry-in mechanism 322 passes is disposed on the front side (left side in FIG. 17B, that is, a side opposite to a side at which the circulator 30 is disposed) of the side wall 331*b* of the drying rack 331 on the sheet carry-in side. A cutout 33*b* to escape carry-out rollers is disposed on the front side (left side in FIG. 17B, that is, a side opposite to a side at which the circulator 30 is disposed) of the side wall 331*b* of the drying rack 331 on the sheet carry-out side.

Similarly with the belt carry-in mechanism illustrated in FIG. 7, the belt carry-in mechanism 322 in the present variation includes a plurality of belt conveyors in the depth direction. However, among the plurality of belt conveyors 322*e*, the belt conveyor 322*e* overlapping the movement regions of the drying rack 331 is only the belt conveyor 322*e* on the front side not interfering with the arms 332. Therefore, in the present variation, the carry-in side cutout 31 of the loading portion 331*a* is disposed only on the front side.

The sheet P is carried into the drying rack 331 through the opening 34 of the side wall 331*b* on the sheet carrying-in side when the belt conveyor 332*e* on the front side (left side in FIG. 17A) overlapping the movement region of the drying rack 331 passes through the cutout 33*a*. The sheet P carried into the drying rack 331 is fully conveyed to the inside of the drying rack 331 by the belt conveyor 332*e* on the front side (left side in FIG. 17A) which overlaps the movement region of the drying rack 331. Such a configuration allows the trailing edge of the sheet in the transport direction to be fully carried into the drying rack 331.

As described above, the sheet P carried into the drying rack 331 is held on the loading portion 331*a* of the drying rack 331 in a manner that the sheet P can be scooped up by the drying rack 331 similarly with the above-described embodiment. The sheet P held on the drying rack 331 is separated from the conveying belt 351 and moves upward in the drying chamber 313.

In the drying assembly of the present variation, since the carry-out unit to carry the sheet P from the drying rack 331 is in the upward movement region A1 in which the drying rack 331 moves upward, a carry-out member to carry out the sheet P contacts the sheet P from above. The drying rack 331 continues to rise even while the sheet P is carried out by the carry-out member. Therefore, for a configuration similar to the configuration of the carry-in unit (the configuration in which the cutout is formed to enter a portion of the carry-out member, such as the belt conveyor 332*e*, into the movement region of the drying rack 331 and escape the carry-out member to the loading portion 331*a* of the drying rack 331), the sheet P would enter the cutout of the loading portion together with the carry-out member in carry-out of the sheet P. As a result, damage, such as wrinkles, may occur on the sheet P. Further, a failure, such as a sheet caught in the cutout and the carry-out member to hamper carry-out of the sheet, may occur. Hence, in the present variation, the carry-out member is swingable between a carry-out position for carrying out the sheet P from the drying rack 331 and a retracted position retracted from the movement region of the drying rack 331. After the sheet P is carried out from the drying rack 331, the carry-out member moves to the retracted position so as not to hamper the movement of the drying rack 331.

Figure 18:
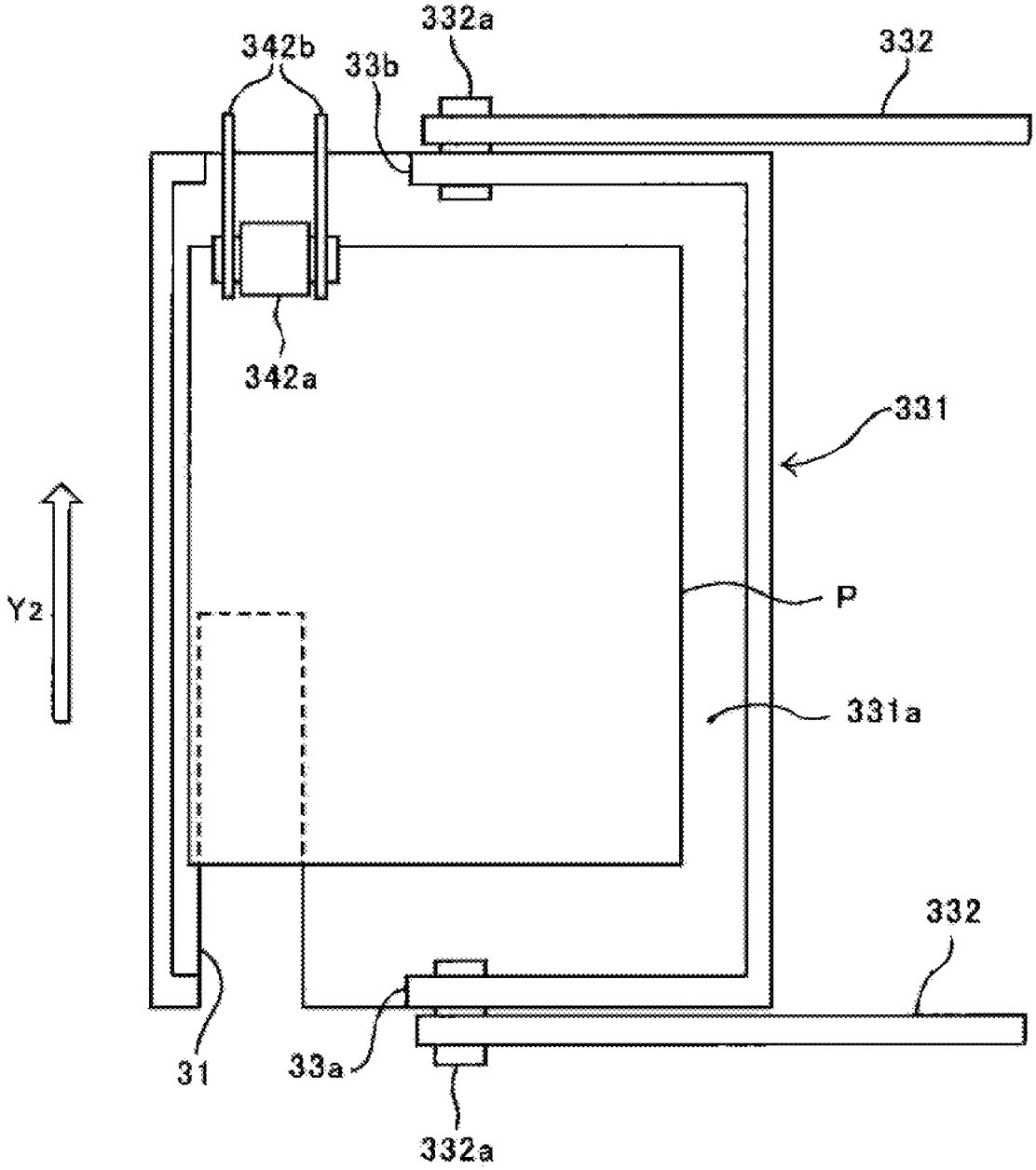
FIG. 18 is a plan view of carry-out of a sheet in the variation of the drying assembly.

FIG. 18 is a plan view of carry-out of the sheet Pin the variation of the drying assembly 301. As illustrated in FIG. 18, the carry-out unit 340 to carry out a sheet P from the drying chamber 313 includes a sheet carry-out roller 342*a* as the carry-out member. The sheet carry-out roller 342*a* is rotatably supported at one end of a pair of sheet carry-out arms 342*b*. The other end of the pair of sheet carry-out arms 342*b* is rotatably supported by the drying unit 300. The sheet carry-out roller 342*a* supported by the pair of sheet carry-out arms 342*b* enters the movement region of the drying rack 331 to carry out the sheet P of the drying rack 331 to swing between the carry-out position, at which the sheet carry-out roller 342*a* carries out the sheet P from the drying rack 331, and the retracted position, at which the sheet carry-out roller 342*a* is retracted from the movement region of the drying rack 331. The sheet carry-out roller 342*a* is driven to rotate by a driving force of a drive motor transmitted by a belt drive transmission assembly. The belt drive transmission assembly includes a pair of pulleys and a timing belt stretched around the pair of pulleys.

When the drying rack 331 holding the sheet P by circulating in the drying chamber 313 returns to the upward movement region A1 again, the sheet P placed on the loading portion 331*a* of the drying rack 331 contacts the sheet carry-out roller 342*a* being driven to rotate. The sheet P is fed in the sheet carry-out direction Y2 by the rotational driving force of the sheet carry-out roller 342*a*, passes through the opening of the side wall, and is carried out from the drying rack 331. While the sheet P is carried out by the sheet carry-out roller 342*a*, the drying rack 331 also rises. However, with the other end of a sheet carry-out arm acting as a fulcrum, the sheet carry-out arm rotates. Accordingly, the sheet carry-out roller 342*a* rises so as to be lifted by the loading portion of the drying rack 331 is placed on the drying rack, thus allowing the sheet P to be conveyed. The sheet P is further lifted after the sheet P is carried out from the drying rack 331. When the sheet P is lifted to a certain extent, the sheet P leaves the drying rack 331. Accordingly, after the sheet P is carried out from the drying rack 331, the sheet carry-out roller 342*a* retracts from the movement region of the drying rack 331 and does not interfere with the movement of the drying rack 331. After the sheet P separates from the drying rack 331, the pair of sheet carry-out arms 342*b* rotate in the direction opposite to the above-described direction, the sheet carry-out roller 342*a* descends and contacts the image surface of the sheet P held on the next drying rack 331.

In the present variation, the sheet carry-out roller 342*a* contacts the image surface of the sheet P. However, since ink on the image surface of the sheet P has already dried, the image formed on the sheet P is not disturbed by the sheet carry-out roller 342*a*. In addition, a drive assembly to drive the pair of sheet carry-out arms 342*b* to rotate may be provided. After the sheet P is carried out from the drying rack 331, the pair of sheet carry-out arms 342*b* may be rotationally driven to forcibly retract the sheet carry-out roller 342*a* to the retracted position.

Figure 19:
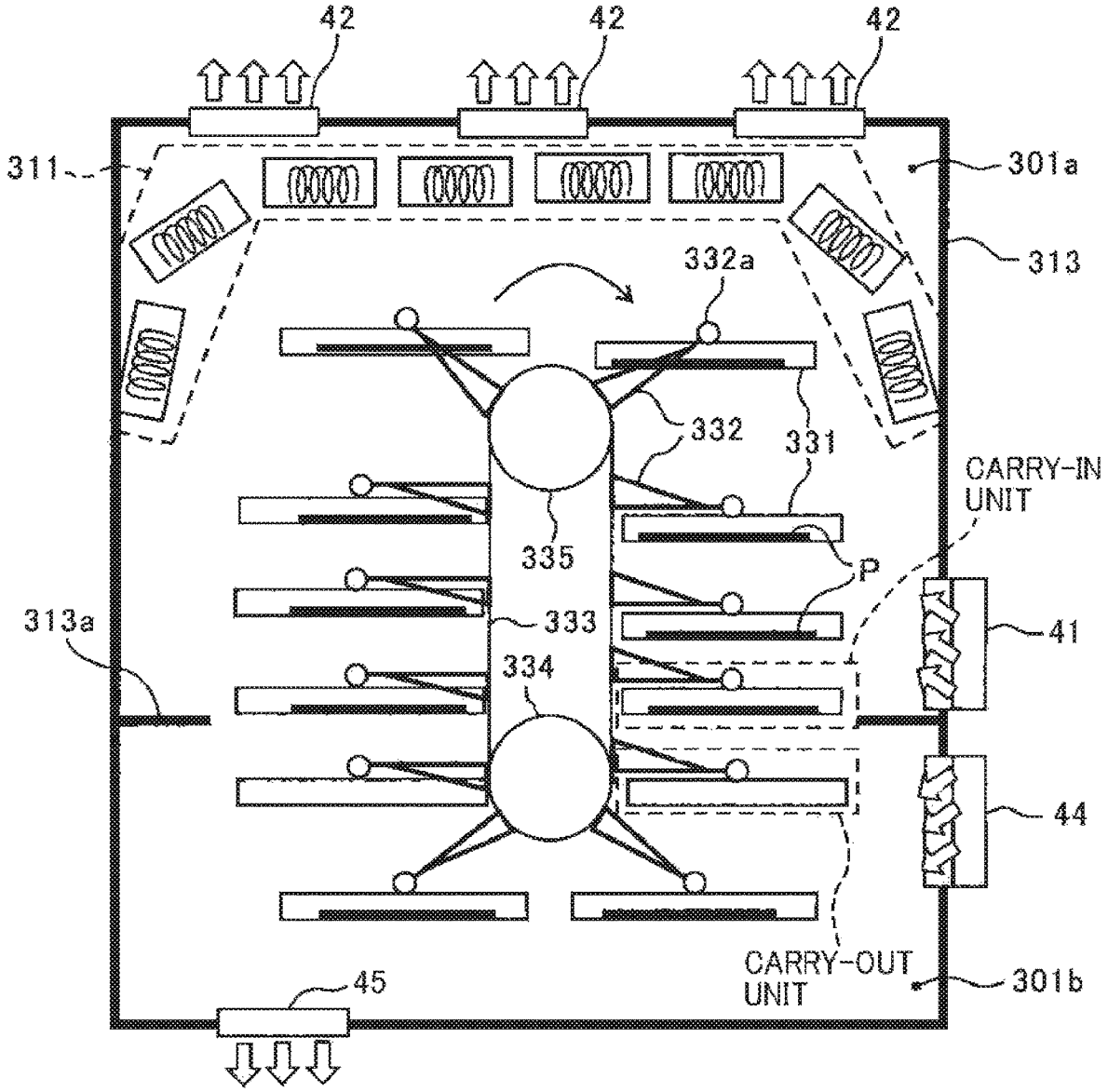
FIG. 19 is a schematic view of an example in which a heating section is at an upper side of the variation of the drying assembly and a cooling section is at a lower side of the drying assembly, seen from the sheet carry-in direction.

FIG. 19 is a schematic view of an example in which an upper part of the drying assembly of the present variation is a heating section 301*a* and a lower part of the drying assembly is a cooling section 301*b* to cool a sheet P, as seen from the sheet carry-in direction Y1. As illustrated in FIG. 19, the cooling section 301*b* at the lower part and the heating section 301*a* at the upper part are partitioned by a partition wall 313*a* except for a space through which the drying racks 331 pass. A blowing fan 41 to blow hot air is disposed below the heating section 301*a*. A plurality of exhaust ports 42 to exhaust hot air in the heating section 301*a* are disposed on an upper wall of the heating section 301*a*. A cooling blower fan 44 to blow cooling air is disposed above the cooling section 301*b*. A cooling-air exhaust port 45 to exhaust the cooling air in the cooling section 301*b* is disposed at a bottom of the cooling section 301*b*.

The sheet P carried into the drying assembly and held on the drying rack 331 moves through the heating section 301*a*. Ink on the image surface of the paper is heated and dried by the hot air sent from the blowing fan 41 and the radiant heat of non-contact heat source unit. The sheet P held on the drying rack 331 and dried by the heating section 301*a* moves to the cooling section 301*b* through the partition wall 313*a*. The sheet P held on the drying rack 331 that has moved to the cooling section 301*b* is cooled by the cooling air sent from the cooling blower fan 44. The sheet P held on the drying rack 331 and cooled by the cooling air is carried out from the drying assembly by the carry-out unit.

By providing the cooling section 301*b* in the drying assembly 301, the size of the inkjet recording apparatus 1 can be reduced as compared with a case in which a cooling assembly is provided to cool a sheet after the sheet is carried out from the drying assembly. Further, providing the cooling section 301*b* below the heating section 301*a* can suppress the air of the cooling section 301*b* from flowing into the heating section 301*a* through the space through which the drying racks 331 pass.

Figure 20:
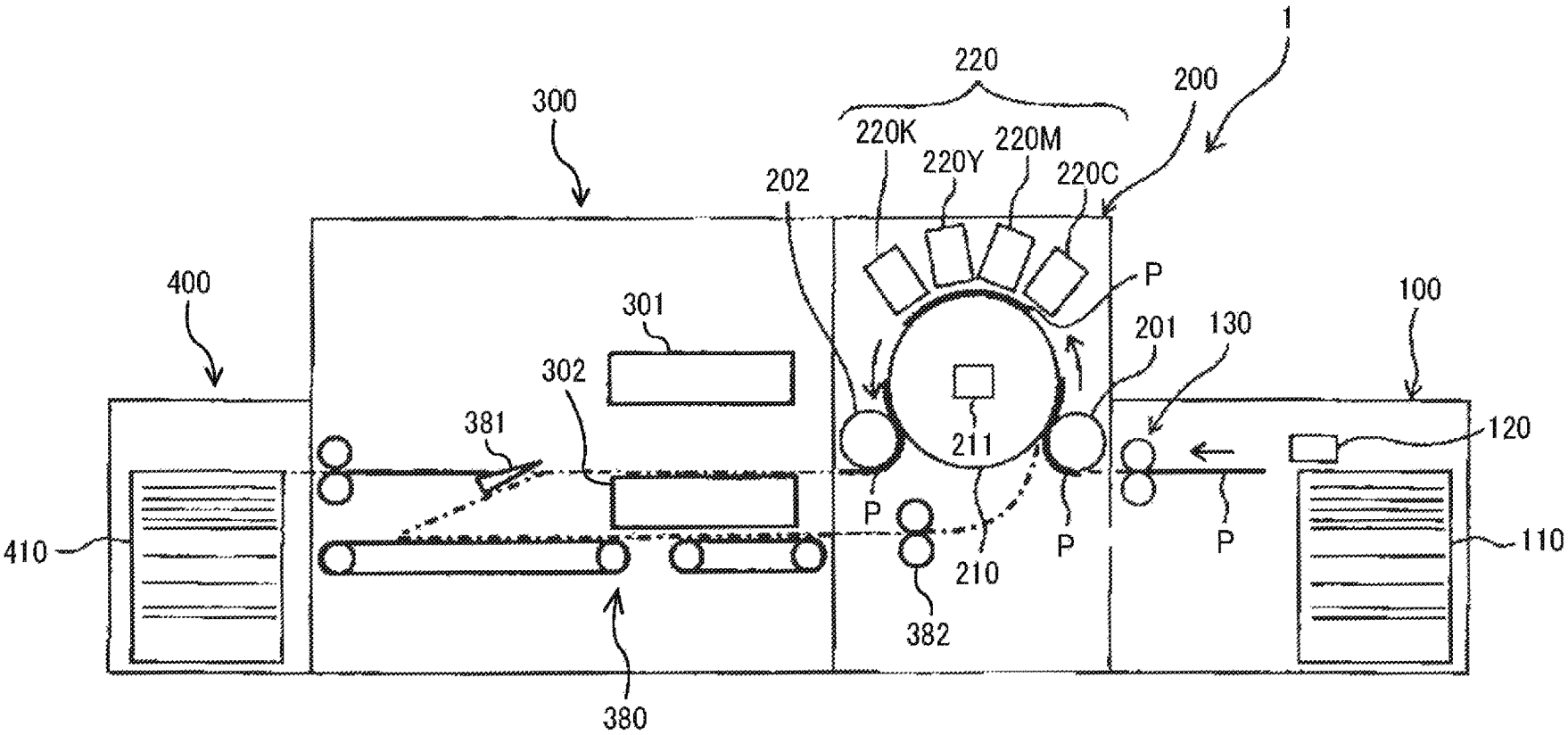
FIG. 20 is a schematic view of an example of the inkjet recording apparatus including a reverse conveying assembly.

FIG. 20 is a schematic view of an example of the inkjet recording apparatus 1 including a reverse conveying assembly 380. As illustrated in FIG. 20, the reverse conveying assembly 380 includes, e.g., a plurality of belt conveyors and a pair of reverse registration rollers 382. A switching claw 381 to selectively switch the sheet conveying destination between the reverse conveying assembly 380 and the sheet ejection unit 400 is swingably disposed on the downstream side of the drying assembly 301 in the sheet conveyance direction.

When images are recorded on both sides of the sheet P, the switching claw 381 is rotated so that the switching claw 381 takes a posture illustrated in FIG. 20. The sheet P ejected from the drying assembly 301 is conveyed to the reverse conveying assembly 380 by the switching claw 381. The sheet P conveyed to the reverse conveying assembly 380 is switched back and conveyed toward the pair of reverse registration rollers 382. After a leading edge of the sheet P reaches the pair of reverse registration rollers 382, the pair of reverse registration rollers 382 is driven at a predetermined timing to feed the sheet P to the ink discharge unit 220 again. An image is formed on the other side of the sheet P.

In the present embodiment, when images are formed on both sides of a predetermined number or more of sheets, the images are formed on both sides of the sheets by interleaf conveyance control. In the interleaf conveyance control, images are continuously formed on first sides of sheets P and the sheets P are conveyed to the reverse conveying assembly 380. Conveyance of the sheets P, on which the images have been formed on the first sides, to the ink discharge unit 220 and conveyance of sheets P from the sheet feeding unit 100 to the ink discharge unit 220 are alternately performed. Such conveyance control can suppress a reduction in productivity when images are formed on both sides of a predetermined number or more of sheets.

In such interleaf conveyance control, the conveyance destination of the switching claw 381 is switched between sheets. Accordingly, if the sheet P moves in the sheet carry-out direction during circulation of the drying rack 331 and the interval between sheets P becomes narrower than the prescribed interval between sheets, the leading edge of the next sheet P would reach the switching claw 381 before the switching of the conveyance destination of the switching claw 381 is completed. Consequently, the next sheet P might be conveyed to a different conveyance destination from the conveyance destination to be originally conveyed, thus causing a conveyance failure.

In addition, if the drying rack 331 moves in the drying rack 331 in the direction opposite to the sheet carry-out direction during circulation of the drying rack 331 and the interval between sheets P becomes greater than the prescribed interval between sheets, the leading end of the sheet P in the sheet conveyance direction might not reach the pair of reverse registration rollers 382 at the start of driving the pair of reverse registration rollers 382. In such a case, a failure might occur that the position of the image formed on the second face opposite the first face shifts from the position of the image formed on the first side of the sheet. Such a failure of positional deviation of image might also occur when images are formed on both sides of a single sheet.

However, in the present embodiment, as described above, since the drying rack 331 circulates while maintaining the posture of the drying rack 331, the movement of the sheet P with respect to the prescribed position in the drying rack 331 is suppressed. Accordingly, the narrowing or spreading of the interval between sheets can be suppressed, thus suppressing the occurrence of conveyance failure and occurrence of positional deviation of the image in the interleaf conveying control.

Figure 21:
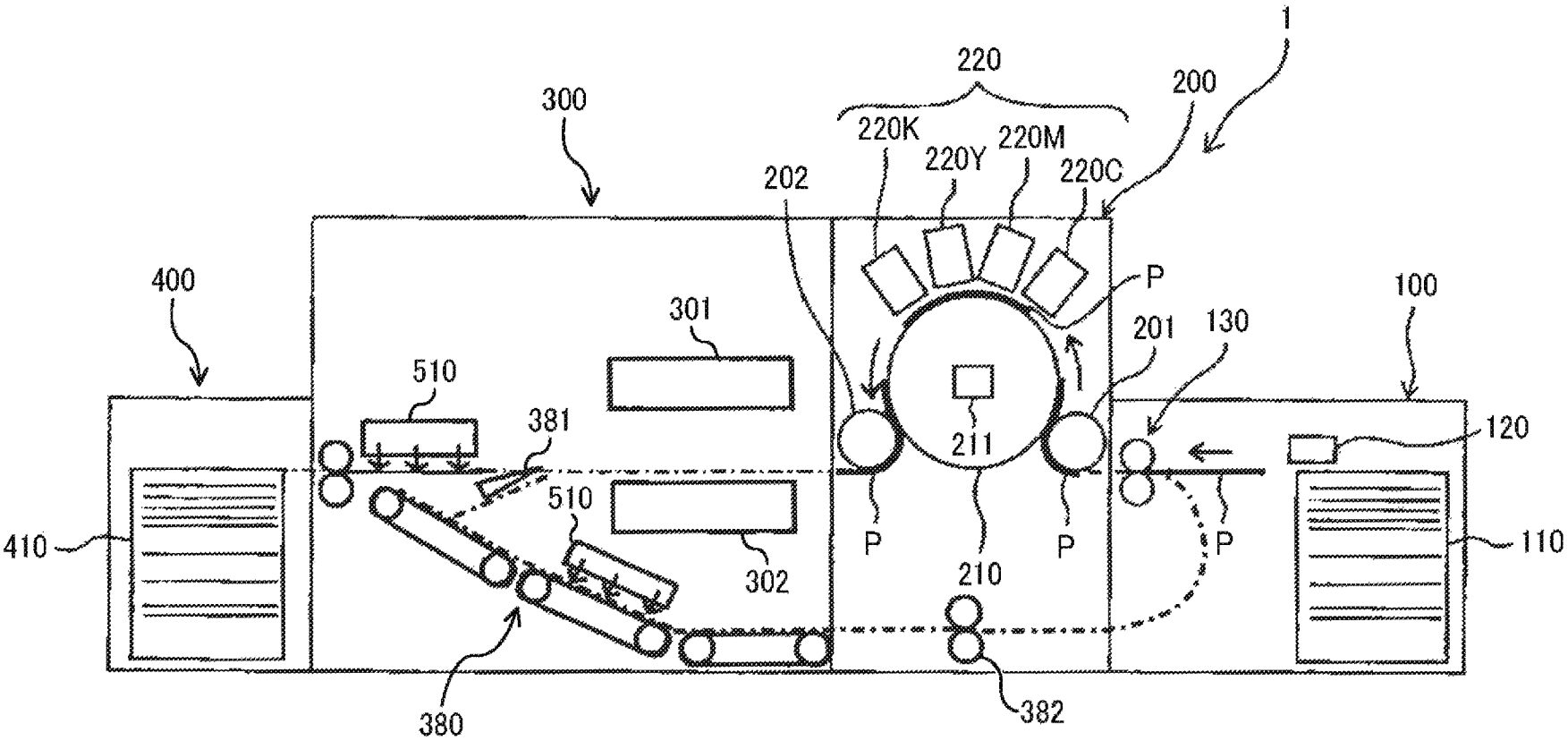
FIG. 21 is a schematic view of another example of the inkjet recording apparatus including the reverse conveying assembly.

FIG. 21 is a schematic view of another example of the inkjet recording apparatus 1 including the reverse conveying assembly 380. In the example illustrated in FIG. 21, a cooler 510 to cool a sheet P is disposed on each of a conveyance path to the sheet ejection unit 400 and a conveyance path of the reverse conveying assembly 380. Further, in the configuration illustrated in FIG. 21, the reverse conveying assembly 380 conveys the sheet P toward the paired registration rollers 130. The cooler 510 includes a plurality of blowing fans to blow cooling air onto the sheet P. By providing the cooler 510 in such a manner, the sheet P, the temperature of which has been increased by the drying assembly 301, can be cooled and conveyed to the sheet ejection unit 400 and the image forming unit 200.

Figure 22:
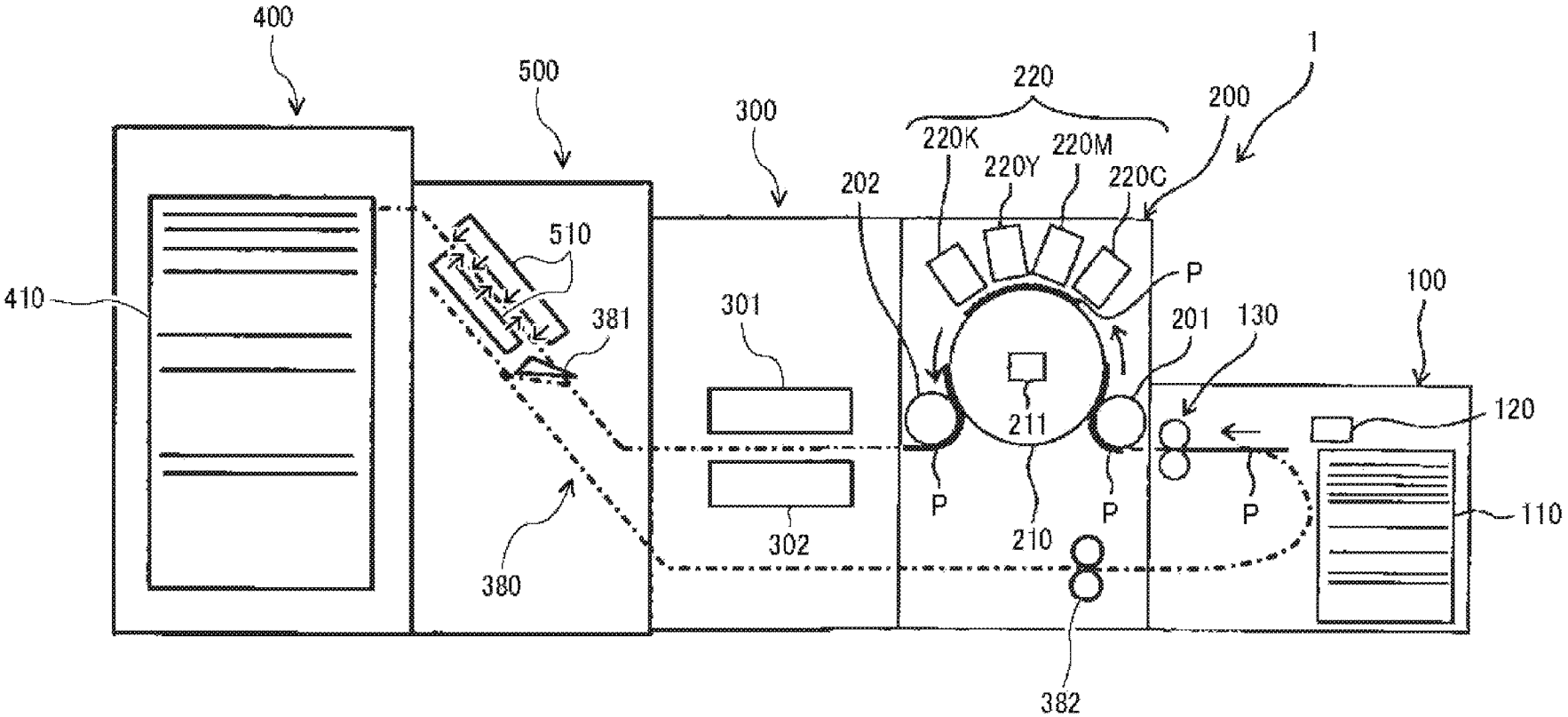
FIG. 22 is a schematic view of still another example of the inkjet recording apparatus including the reverse conveying assembly.

FIG. 22 is a schematic view of still another example of the inkjet recording apparatus 1 including the reverse conveying assembly 380. In FIG. 22, a reverse cooling unit 500 is disposed as a post-processing unit between the drying unit 300 and the sheet ejection unit 400. The reverse cooling unit 500 includes the switching claw 381 and the coolers 510. When an image is formed on the other surface of a sheet P, the sheet P is conveyed to the reverse conveying assembly 380 by the reverse cooling unit 500. On the other hand, when the sheet P is conveyed to the sheet ejection unit 400, the sheet P is cooled by the coolers 510 and then conveyed to the sheet ejection unit 400.

Next, a description is given of a variation of the drying unit 300 in the present embodiment. In the above-described embodiment, an example of the drying unit 300 has been described that dries a sheet after ink is discharged and an image is formed. In the present variation, a treatment is performed in which a predetermined treatment liquid is imparted to the sheet P by, for example, application in the pre-processing unit. Before ink is discharged to form an image in the image forming unit 200, the sheet applied with the treatment liquid is dried in the drying unit.

Figure 23:
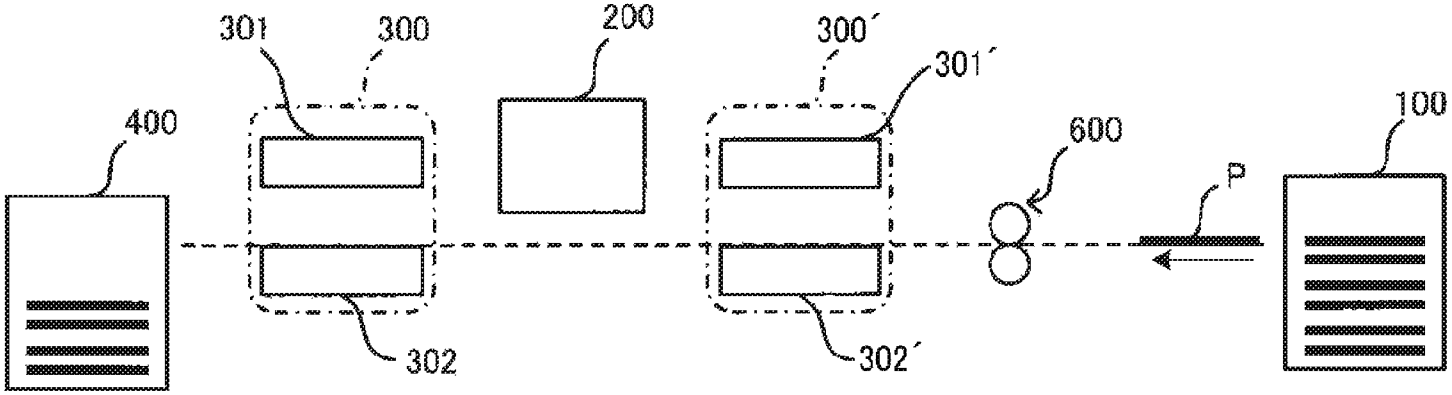
FIG. 23 is a schematic view of a configuration of the inkjet recording apparatus including a pre-processing unit.

FIG. 23 is a schematic view of a configuration of an inkjet recording apparatus including a pre-processing unit. An inkjet recording apparatus 1 illustrated in FIG. 23 has substantially the same basic configuration as the basic configuration of the inkjet recording apparatus 1 according to the above-described embodiment, except that a pre-processing unit 600 and a drying unit 300' are added between the sheet feeding unit 100 and the image forming unit 200. The basic configuration of the added drying unit 300' is also the same as in the above-described embodiment. Therefore, differences from the above-described embodiment are mainly described below.

Figure 24:
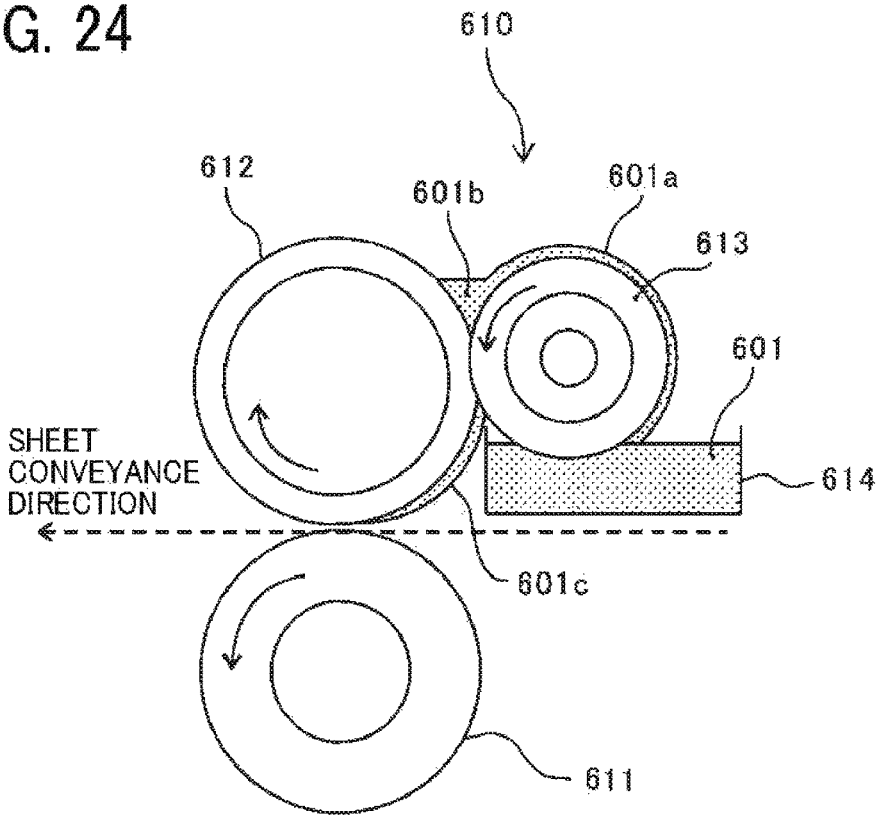
FIG. 24 is an illustration of a main part of an application device of the inkjet recording apparatus of FIG. 23.

FIG. 24 is an illustration of a main part of an application device 610 as the pre-processing unit used in the present variation. The pre-processing unit 600 includes an application device 610 to apply a treatment liquid to the sheet P fed from the sheet feeding unit 100. An example of the treatment liquid is a modifying material to modify a surface of the sheet P by being applied to the surface of the sheet P. For example, the modifying material may be a fixing agent (setting agent) to be uniformly applied to the sheet P in advance to quickly permeate the moisture of ink into the sheet P, thicken color components, and accelerate drying. Thus, the fixing agent can prevent bleeding (e.g., feathering or bleeding) and bleed-through and enhance productivity (the number of images output per unit time).

Compositionally, as the treatment liquid, for example, a solution can be used in which cellulose (for example, hydroxypropyl cellulose) that promotes permeation of moisture and a base material, such as talc fine powder, are added to surfactant (for example, any one of anionic, cationic, and nonionic surfactants, or a mixture of two or more of the foregoing surfactants). The treatment liquid may also contain fine particles.

The application device 610 of the present variation includes a conveyance roller 611 to convey the sheet P, an application roller 612 to apply a treatment liquid 601 to the sheet P to face the conveyance roller 611, and a squeeze roller 613 to supply the treatment liquid 601 to the application roller 612 to thin a liquid film (a film of the treatment liquid 601). The directions of rotation of the conveyance roller 611, the application roller 612, and the squeeze roller 613 are indicated by arrows in FIG. 24. The application roller 612 is disposed in contact with the conveyance roller 611, and the squeeze roller 613 is disposed in contact with the application roller 612.

When the treatment liquid 601 is applied to the sheet by the application device 610, by the rotation of the squeeze roller 613 in the direction indicated by an arrow in FIG. 24, the treatment liquid 601 in the liquid tray 614 is scooped up by the surface of the squeeze roller 613, is transferred in the state of the liquid film layer 601*a* by the rotation, and is accumulated on a valley portion (contact portion: nipping portion) between the squeeze roller 613 and the application roller 612 (treatment liquid 601*b*). Here, the squeeze roller 613 and the application roller 612 are in contact with each other at a constant pressing force. When the treatment liquid 601*b* stored in the valley portion passes between the squeeze roller 613 and the application roller 612, the treatment liquid 601*b* is squeezed by pressure. A liquid film layer 601*c* of the treatment liquid 601 is formed and is conveyed to the conveyance roller 611 side by the rotation of the application roller 612. The liquid film layer 601*c* transferred by the application roller 612 is applied to the sheet P.

The sheet applied with the liquid film layer 601*c* of the treatment liquid 601 in such a manner is conveyed to the drying unit 300' having substantially the same configuration as the drying unit 300 of the above-described embodiment, and the drying process is performed. The sheet having been subjected to the drying process by the drying unit 300' is fed to the image forming unit 200, and an image is formed by discharging of ink in the image forming unit 200.

Figure 25:
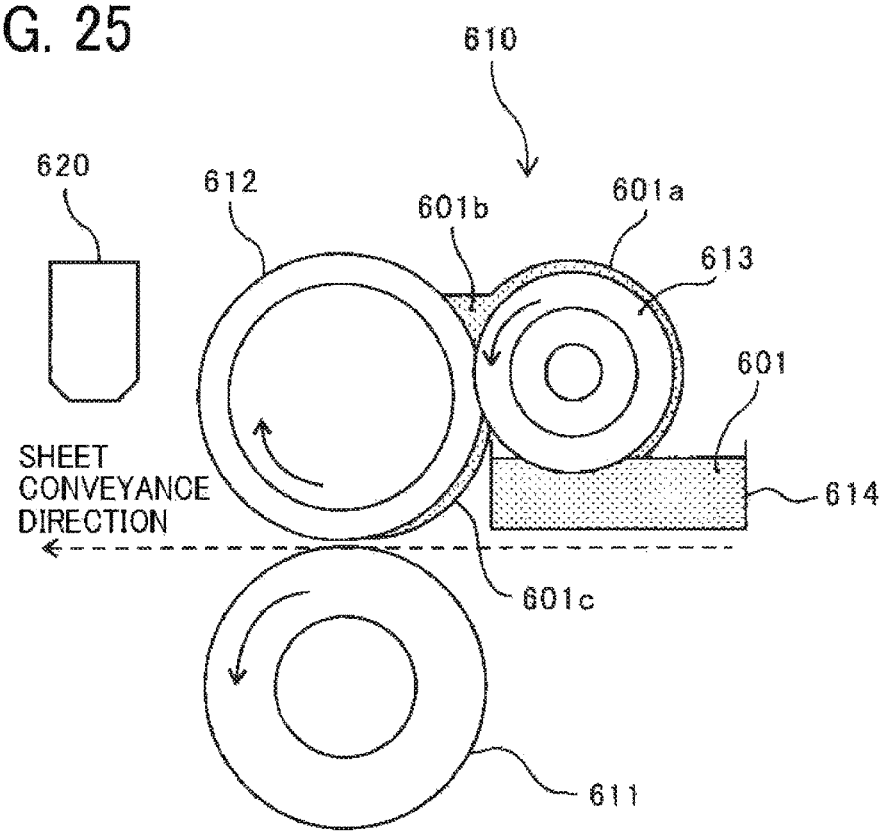
FIG. 25 is a schematic view of an example of the inkjet recording apparatus in which an exposure light source is disposed downstream from the application device in a sheet conveyance direction.

As illustrated in FIG. 25, an exposure light source 620 as exposure device to emit active energy rays, such as ultraviolet rays, may be disposed downstream from the application device 610 in the sheet conveyance direction. Accordingly, after the treatment liquid 601 is applied to the sheet P, the treatment liquid 601 are irradiated with the active energy rays and are partially cured (semi-cured). Then, the treatment liquid 601 is dried in the drying unit 300'. The example illustrated in FIG. 25 is particularly effective in a case in which the treatment liquid 601 contains a photo-polymerization initiator and has a relatively high content of moisture.

In such a case, the treatment liquid 601 preferably contains a photo-polymerization initiator. The photo-polymerization initiator is preferably a photo-radical polymerization initiator. Examples of the photo-polymerization initiator include, but are not limited to, aromatic ketones, phosphine oxide compounds, aromatic onium salt compounds, organic peroxides, thio compounds, hexaaryl biimidazole compounds, ketoxime ester compounds, borate compounds, azinium compounds, metallocene compounds, active ester compounds, carbon-halogen-bond-containing compounds, and alkylamine compounds.

Examples of the active energy ray include, but are not limited to, ultraviolet ray, visible light, α-ray, γ-ray, X-ray, and electron ray. Examples of the exposure light source 620 to emit the active energy ray include, but are not limited to, a mercury lamp, a metal halide lamp, a light emitting diode, and a laser diode.

Figure 26:
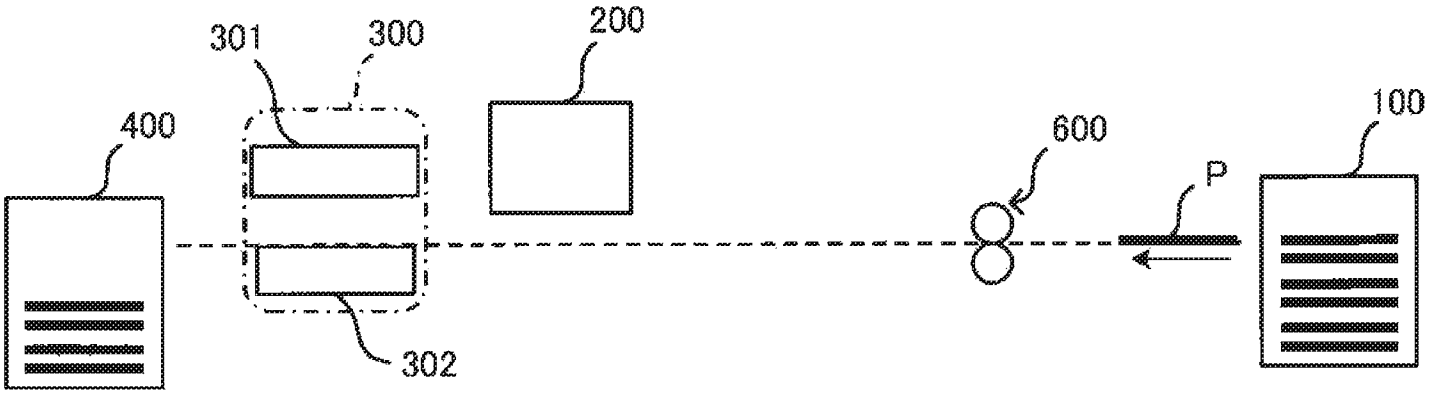
FIG. 26 is a schematic view of an example of the inkjet recording apparatus in which the drying unit is not disposed between the pre-processing unit and an image forming unit.

In the present variation, the drying unit 300' is disposed between the pre-processing unit 600 and the image forming unit 200. The sheet P applied with the treatment liquid 601 by the application device 610 of the pre-processing unit 600 is dried before ink is discharged to form an image in the image forming unit 200. However, the arrangement is not limited to the example of the present variation. For example, as illustrated in FIG. 26, no drying unit may be disposed between the pre-processing unit 600 and the image forming unit 200. The drying unit 300 disposed downstream from the image forming unit 200 in the sheet conveyance direction may collectively dry the treatment liquid 601 applied by the application device 610 of the pre-processing unit 600 and ink discharged by the image forming unit 200. Note that, in a case in which the treatment liquid 601 containing a photo-polymerization initiator is used, the exposure light source 620 illustrated in FIG. 25 may be disposed between the image forming unit 200 and the drying unit 300.

The above-described embodiments are limited examples, and the present disclosure includes, for example, the following aspects having advantageous effects.

Aspect 1

A drying device to dry a drying target member, such as a sheet P, includes a plurality of holders, such as the plurality of drying racks 331, to hold the drying target member, and a circulator, such as the circulator 30, to circulate the plurality of holders. The plurality of holders are supported by the circulator 30 to rotate with respect to the circulator. According to aspect 1, the holders, such as the drying racks 331, are rotatably supported with the circulator, such as the circulator 30, thus allowing the holders to rotate with respect to the circulator in conjunction with the circulation of the circulator Therefore, with the circulation of the circulator, the holders are rotated with respect to the circulator forcibly by a rotating unit, such as the guide assembly, or automatically by their own weights of the holders. For example, a drying target member of a sheet shape held by the holder can be maintained in a posture in which the drying target member does not buckle. Even when the drying target member held by the holder is a sheet-shaped member, such as a sheet of paper, having low rigidity, such a configuration can prevent buckling during circulation.

Aspect 2

In aspect 1, the circulator, such as the circulator 30, is configured to move the holders, such as the drying racks 331, along an arc trajectory. According to aspect 2, as described in the above-described embodiment, the holder, such as the drying rack 331, can move in the vertical direction while moving in the horizontal direction. Such a configuration allows one of the holders to move in the horizontal direction while taking a position different from the positions of adjacent holders in the vertical direction. Therefore, the holders do not collide with each other even if the holders do not largely move in the horizontal direction. Such a configuration can obviate the necessities to move the holders in the horizontal direction at high speed and suddenly accelerate and decelerate the holders in the turning regions. Accordingly, the movement of the drying target member, such as the sheet P, held on the holder can be suppressed, thus locating the drying target member at the prescribed position in the holder. Further, the interval between the holders can be narrowed, and the productivity can be enhanced. Further, since the interval between the holders can be narrowed, the moving speed of the holder can be set to be slow relative to the carry-in speed and the carry-out speed of the drying target member. Even if the circulation distance of the holder is relatively short, the drying target member can be stayed in the drying chamber for a relatively long time. Such a configuration can downsize the drying device and favorably dry a drying target portion, such as ink on a drying target member.

Aspect 3

In Aspect 1 or 2, a heating section, such as the heating section 301*a* to heat a drying target member, such as the sheet P, and a cooling section, such as the cooling section 301*b*, to cool the drying target member, which has been heated in the heating section, are provided, The heating section and the cooling section are included in a circulation route of the drying target member. According to aspect 3, as described with reference to FIG. 19, after the drying target member, such as the sheet P, is heated, the drying target member can be cooled and carried out.

Aspect 4

In aspect 3, the heating section, such as the heating section 301*a*, and the cooling section, such as the cooling section 301*b*, are arranged side by side in a direction orthogonal to a carried-in direction in which the drying target member, such as the sheet P, is carried into the holder, such as drying rack 331. According to aspect 4, the drying device can be downsized in the carried-in direction as compared with a case in which the heating section, such as the heating section 301*a*, and the cooling section, such as the cooling section 301*b*, are arranged side by side in the carry-in direction in which the drying target member, such as the sheet P, is carried-in to the holder, such as drying rack 331.

Aspect 5

In aspect 3 or 4, an arrangement direction in which the heating section, such as the heating section 301*a*, and the cooling section, such as the cooling section 301*b*, are arranged is the vertical direction. the heating section is an upper part, and the cooling section is a lower part. According to aspect 5, as described with reference to FIG. 19, an inflow of air from the cooling section to the drying section can be suppressed, thus suppressing a reduction in temperature in the drying section.

Aspect 6

In any of aspects 1 through 5, a non-contact heat source, such as the non-contact heat source unit 311, to apply heat to the drying target member, such as the sheet P, in a non-contact manner is disposed on an upper side of the drying device. According to aspect 6, as described in the above-described embodiment, radiant heat of the non-contact heat source can be directly imparted to the drying target member, such as the sheet P, and the drying target portion, such as ink on the drying target member can be favorably dried.

Aspect 7

In any of aspects 1 through 6, the circulator, such as the circulator 30, includes a rotary driver, such as the conveyor chain 333, which is driven to rotate, and a plurality of arms, such as the plurality of arms 332, mounted to the rotary driver and rotatably supporting the holders, such as the drying racks 331.

Aspect 8

In aspect 7, the holder, such as the drying rack 331, includes a loading portion, such as the loading portion 331*a*, on which the drying target member, such as the sheet P, is loaded. The holder circulates in a state in which the loading portion is placed lower than a rotation shaft, such as the shaft 332*a*, of the arm, such as the arm 332. According to aspect 8, the holder, such as the drying rack 331, automatically rotates relative to the arm, such as the arm 332, by its own weight, thus allowing the loading portion, such as the loading portion 331*a*, to be maintained in a horizontal posture.

Aspect 9

In any of aspects 1 through 8, the holder, such as the drying rack 331, includes a loading portion, such as the loading portion 331*a*, on which the drying target member, such as the sheet P, is loaded. The drying device includes a guide (in the present embodiment, is formed of, e.g., the upper guide members 20*a* and 20*b*, the side surfaces of the drying chamber 313, the first turning guide 23*a*, the second turning guide 23*b*) to guide the holders so that the loading portion, such as the loading portion 331*a*, circulates while maintaining a horizontal posture.

According to aspect 9, as described with reference to FIGS. 11A, 11B, and 12, when an impact or vibration occurs in the drying device, swinging of the holders, such as the drying racks 331, can be suppressed, thus suppressing the movement of the drying target member, such as the sheet P, in the holder.

Aspect 10

In any one of aspects 1 through 9, a center-of-gravity adjuster to adjust the position of center of gravity of the holder, such as the drying rack 331, is provided with the holder. According to aspect 10, as described with reference to FIG. 13, even when the position of center of gravity of the holder, such as the drying rack 331, deviates from a target position due to, e.g., manufacturing error, the position of center of gravity of the holder can be adjusted to the target position by the center-of-gravity adjuster.

Aspect 11

In aspect 10, the center of gravity adjuster includes a weight, such as the weight 40, and a holding portion, such as the holding portion 331*c*, on the holder, such as the drying rack 331, to hold the weight. According to aspect 11, as described with reference to FIG. 13, the weight 40 held on the holding portion 331*c* allows the position of the center of gravity of the holder, such as the drying rack 331, to be easily adjusted to the target position.

Aspect 12

In any of aspects 1 through 11, the drying device includes a carry-out member, such as the sheet carry-out roller 342*a*, to carry out the drying target member, such as the sheet P, from the holder, such as the drying rack 331. The carry-out member is movable between the carry-out position at which the carry-out member carries out drying target member from the holder and a retracted position at which the carry-out member retracts from the movement region of the holder. According to aspect 12, as described with reference to FIG. 18, after the drying target member, such as the sheet P, held by the holder, such as the drying rack 331, is carried out from the holder by the carry-out member, such as the sheet carry-out roller 342*a*, the carry-out member is located at the retracted position at which the carry-out member retracts from the movement region of the holder. Such a configuration can prevent the carry-out member from hampering the movement of the holder, such as the drying rack 331.

Aspect 13

In any of aspects 1 through 12, the circulator, such as the circulator 30, includes a rotary driver, such as the conveyor chain 333, to be driven to rotate. The rotary driver is made of metal. According to aspect 13, as described in the above-described embodiment, heat resistance can be more enhanced and thermal expansion can be more suppressed than a case in which the rotary driver is made of resin. Accordingly, the holder, such as the drying rack 331, can be stably circulated.

Aspect 14

In any of aspects 1 through 13, the circulator, such as the circulator 30, includes a rotary driver driven to rotate. The rotary driver includes a chain, such as the conveyor chain 333. According to aspect 14, as described with respect to FIG. 4, the holders, such as the drying racks 331, can be easily arranged at a prescribed pitch.

Aspect 15

In any of aspects 1 to 14, the circulator, such as the circulator 30, is configured to circulate the plurality of holders around an imaginary axis extending in the direction perpendicular to the direction in which the drying target member, such as the sheet P, is carried into the holder, such as the drying rack 331. According to aspect 15, both ends of the holder, such as the drying rack 331, in the direction in which the drying target member is carried into the holder can be rotatably supported by arms, thus preventing the arms from hampering carry-in of the drying target member into the holder.

Aspect 16

In any of aspects 1 through 15, the drying device includes a conveyor, such as the belt conveyor 322*e*, to carry the drying target member, such as the sheet P, into the holder, such as the drying rack 331. A portion of the conveyor enters the movement region of the holder. The holder includes an escape portion, such as the carry-in-side cutouts 31, to escape the conveyor. As described in the above-described embodiment, a portion of the conveyor, such as the belt conveyor 322*e*, enters the movement region of the holder, such as the drying rack 331, thus allowing the drying target member, such as the sheet P, to be reliably carried to the inside of the holder. Further, the escape portion, such as carry-in-side cutouts 31, to escape the conveyor allows the holder to circulate without striking the conveyor, such as the belt carry-in mechanism 322.

Aspect 17

In any of aspects 1 through 14, the carry-in direction in which the drying target member, such as the sheet P, is carried into the holder, such as the drying rack 331, is the same as the carry-out direction in which the drying target member held on the holder is carried out from the holder. The circulator, such as the circulator 30, is configured to circulate the plurality of holders around an imaginary axis extending in the same direction as the carry-in direction in which the drying target member is carried into the holder.

According to aspect 17, as described with reference to, e.g., FIG. 15, the drying device can be downsized in the carry-in direction in which the drying target member, such as the sheet P, is carried into the holder, such as the drying rack 331, as compared with a case in which the horizontal axis is set in the direction orthogonal to the carry-in direction in which the drying target member is carried into the holder. In addition, for the configuration in which the carry-in direction in which the drying target member is carried into the holder is the same as the carry-out direction in which the drying target member held by the holder is carried out from the holder, the drying target member held by the holder can be carried out after almost one turn in the device, thus allowing the drying target portion, such as ink, on the drying target member, to be favorably dried.

Aspect 18

In aspect 17, the drying device includes a plurality of conveyors, such as the belt conveyors 322*e*, to convey the drying target member, such as the sheet P, into the holder, such as the drying rack 331. The plurality of conveyors are arranged in the direction orthogonal to the carry-in direction in which the drying target member is carried into the holder. Among the plurality of conveyors, a portion of the conveyor that is disposed outside the movement region of the arms, such as the arms 332, of the circulator, such as the circulator 30, to rotatably support the holder enters the movement region of the holder. The holder includes an escape portion to escape the conveyor. According to aspect 18, as described with reference to FIGS. 17A and 17B, a portion of the conveyor, such as the belt conveyor 322*e*, disposed outside the movement region of the arms, such as the arms 332, enters the movement region of the holder, thus allowing the drying target member, such as the sheet P, to be reliably carried to the inside of the holder, such as the drying rack 331. The holder includes the escape portion, such as the carry-in-side cutout 31, to escape the conveyor and only the conveyor disposed outside the movement region of the arms, such as the arms 332, enters the movement region of the holder. Such a configuration can circulate the holder while preventing the conveyor from colliding with the arms, such as the arms 332, and the holder, such as the drying rack 331.

Aspect 19

A printing apparatus, such as the inkjet recording apparatus 1, includes a liquid discharger, such as the liquid discharge heads 220C, 220M, 220Y and 220K, to discharge liquid, such as ink, onto a surface of a sheet material, such as the sheet P, and the drying device according to any one of the above-described aspects 1 to 18, such as the drying unit 300, to dry the liquid discharged by the liquid discharger. According to aspect 19, the ink can be dried without buckling of the sheet material.

Aspect 20

A printing apparatus includes a liquid discharger, such as the liquid discharge heads 220C, 220M, 220Y and 220K, to discharge liquid, such as ink, onto a surface of a sheet material, such as the sheet P, a pre-processing unit, such as the pre-processing unit 600, disposed upstream from the liquid discharger in a direction of conveyance of the sheet material, to apply a treatment liquid to the sheet material before the liquid is discharged to the sheet material, and the drying device, such as the drying unit 300, according to any one of aspects 1 through 18 to dry the sheet material on which the treatment liquid has been applied by the pre-processing unit. According to aspect 20, the treatment liquid can be dried without buckling of the sheet material.

The above-described embodiments are illustrative and are not intended to limit the present disclosure. Thus, numerous additional modifications and variations are possible in light of the above teachings. For example, elements and/or features of different illustrative embodiments may be combined with each other and/or substituted for each other within the scope of the present invention.

What is claimed is:

1. A drying device to dry a drying target member, the drying device comprising:

a plurality of holders configured to hold the drying target member; and a circulator configured to circulate the plurality of holders around an outer circumference of the circulator, the plurality of holders supported by and disposed radially away from the circulator and configured to rotate with respect to the circulator to maintain a horizontal attitude as the plurality of holders circulate around the outer circumference of the circulator.

2. The drying device according to claim 1, wherein the circulator is configured to move the plurality of holders along an arc trajectory.

3. The drying device according to claim 1, further comprising a heating section to heat the drying target member and a cooling section to cool the drying target member heated in the heating section, wherein the heating section and the cooling section are included in a circulation route of the drying target member.

4. The drying device according to claim 3, wherein the heating section and the cooling section are arranged side by side in a direction orthogonal to a carry-in direction in which the drying target member is carried into the plurality of holders.

5. The drying device according to claim 3, wherein the heating section and the cooling section are arranged in a vertical direction, and wherein the heating section is at an upper side of the drying device and the cooling section is at a lower side of the drying device.

6. The drying device according to claim 1, further comprising a non-contact heat source disposed in an upper part of the drying device, to apply heat to the drying target member in a non-contact manner.

7. The drying device according to claim 1, wherein the circulator includes a rotary driver and a plurality of arms, and wherein the plurality of arms are mounted to the rotary driver, to rotatably support the plurality of holders.

8. The drying device according to claim 7, wherein each of the plurality of holders includes a loading portion on which the drying target member is to be loaded, and wherein each of the plurality of holders circulates in a state in which the loading portion is located lower than a rotation shaft of the plurality of arms.

9. The drying device according to claim 1, wherein each of the plurality of holders includes a loading portion on which the drying target member is to be loaded, and wherein the drying device further comprises a guide to guide the plurality of holders so that each of the plurality of holders circulates while maintaining the loading portion in a horizontal posture.

10. The drying device according to claim 1, wherein each of the plurality of holders includes a center-of-gravity adjuster to adjust a position of center of gravity of each of the plurality of holders.

11. The drying device according to claim 10, wherein the center-of-gravity adjuster includes a weight and a holding portion to hold the weight.

12. The drying device according to claim 1, further comprising a carry-out member to carry out the drying target member from the plurality of holders, wherein the carry-out member is movable between a carry-out position at which the carry-out member carries out the drying target member from the plurality of holders and a retracted position at which the carry-out member retracts from a movement region of the plurality of holders.

13. The drying device according to claim 1, wherein the circulator includes a rotary driver made of metal.

14. The drying device according to claim 1, wherein the circulator includes a rotary driver including a chain.

15. The drying device according to claim 1, wherein the circulator is configured to circulate the plurality of holders around an imaginary axis extending in a direction perpendicular to a carry-in direction in which the drying target member is carried into the plurality of holders.

16. The drying device according to claim 1, further comprising a conveyor to carry the drying target member into the plurality of holders, wherein a portion of the conveyor enters a movement region of the plurality of holders, and wherein each of the plurality of holders includes an escape portion to escape the conveyor.

17. The drying device according to claim 1, wherein a carry-in direction in which the drying target member is carried into each of the plurality of holders is same as a carry-out direction in which the drying target member held on each of the plurality of holders is carried out from each of the plurality of holders, and wherein the circulator is configured to circulate the plurality of holders around an imaginary axis extending in a same direction as the carry-in direction.

18. The drying device according to claim 1, further comprising a plurality of conveyors to carry the drying target member into each of the plurality of holders, wherein the plurality of conveyors are arranged in a direction perpendicular to a carry-in direction in which the drying target member is carried into each of the plurality of holders, wherein a portion of at least one conveyor, among the plurality of conveyors, disposed outside a movement region of arms of the circulator to rotatably support the plurality of holders enters a movement region of the plurality of holders, and wherein each of the plurality of holders includes an escape portion to escape the at least one conveyor.

19. A printing apparatus comprising:

a liquid discharger to discharge liquid onto a sheet; and the drying device according to claim 1 to dry the liquid discharged by the liquid discharger and adhered to the sheet.

20. A printing apparatus comprising:

a liquid discharger to discharge liquid onto a sheet;

a pre-processing unit disposed upstream from the liquid discharger in a direction of conveyance of the sheet, to apply a treatment liquid to the sheet before the liquid is discharged to the sheet; and the drying device according to claim 1 to dry the sheet on which the treatment liquid has been applied by the pre-processing unit.

* * * * *